US012287135B2

(12) United States Patent
Hong et al.

(10) Patent No.: US 12,287,135 B2
(45) Date of Patent: Apr. 29, 2025

(54) ICE MAKER AND REFRIGERATOR

(71) Applicant: LG Electronics Inc., Seoul (KR)

(72) Inventors: Jinil Hong, Seoul (KR); Yonghyun Kim, Seoul (KR); Seungjin Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 197 days.

(21) Appl. No.: 16/685,829

(22) Filed: Nov. 15, 2019

(65) Prior Publication Data

US 2020/0158405 A1 May 21, 2020

(30) Foreign Application Priority Data

Nov. 16, 2018 (KR) ..... 10-2018-0142057

(51) Int. Cl.
*F25C 1/243* (2018.01)
*F25C 1/04* (2018.01)
(Continued)

(52) U.S. Cl.
CPC ..... *F25C 1/243* (2013.01); *F25C 1/04* (2013.01); *F25C 1/10* (2013.01); *F25D 11/02* (2013.01);
(Continued)

(58) Field of Classification Search
CPC .... F25C 1/243; F25C 1/04; F25C 1/10; F25C 2400/06; F25C 1/24; F25C 5/08;
(Continued)

(56) References Cited

U.S. PATENT DOCUMENTS 2,083,081 A 6/1937 Moll
2,969,651 A * 1/1961 Bauerlein ..... F25C 1/04 62/353
(Continued)

FOREIGN PATENT DOCUMENTS

EP 2549207 1/2013
EP 2674702 B1 9/2018
(Continued)

OTHER PUBLICATIONS

KR 20080023426 A, machine translation (Year: 2024).*
(Continued)

*Primary Examiner* — Eric S Ruppert
*Assistant Examiner* — Kirstin U Oswald
(74) *Attorney, Agent, or Firm* — Fish & Richardson P.C.

(57) ABSTRACT

An ice maker of the present embodiment comprises: an upper tray including an upper tray body defining an upper chamber that is a portion of an ice chamber for generating ice; and a lower tray rotated relative to the upper tray based on a rotational center, and including a lower tray body defining a lower chamber that is another portion of the ice chamber, wherein a top surface of the lower tray body can contact a bottom surface of the upper tray body, the rotational center is disposed outside of the upper chamber and the lower chamber, the bottom surface of the upper tray body includes a first surface and a second surface disposed farther from the rotational center than the first surface, and before the top surface of the lower tray body contacts the bottom surface of the upper tray body, the second surface is lower than the first surface.

22 Claims, 31 Drawing Sheets

(51) Int. Cl.
*F25C 1/10* (2006.01)
*F25D 11/02* (2006.01)

(52) U.S. Cl.
CPC .. *F25C 2305/0221* (2021.08); *F25C 2400/06* (2013.01)

(58) Field of Classification Search
CPC .. F25C 2305/022; F25C 5/22; F25C 2500/06; F25C 2500/02; F25C 2500/08; F25C 1/25; F25C 2400/08; F25C 2400/10; F25C 2600/04; F25C 2305/0221; F25C 2700/12; F25D 11/02
USPC ..... 62/340
See application file for complete search history.

(56) References Cited

U.S. PATENT DOCUMENTS 3,055,186 A * 9/1962 Linstromberg ..... F25C 1/04 206/820
3,596,477 A * 8/1971 Harley ..... F25C 1/04 62/353
3,721,103 A * 3/1973 Brandt ..... F25C 1/04 62/73
3,724,804 A * 4/1973 Campbell ..... F25C 1/243 D15/90
3,736,767 A * 6/1973 Lukes ..... A23G 9/221 62/73
4,910,974 A 3/1990 Hara
6,732,537 B1 * 5/2004 Anell ..... F25D 17/065 62/353
9,074,802 B2 * 7/2015 Culley ..... F25C 1/25
9,234,688 B2 1/2016 Son et al.
9,234,689 B2 * 1/2016 Son ..... F25C 1/10
2004/0099004 A1 * 5/2004 Somura ..... F25C 1/22 62/340
2005/0160741 A1 * 7/2005 Park ..... F25C 1/22 62/340
2005/0257536 A1 * 11/2005 Chung ..... F25C 5/187 62/344
2007/0084229 A1 * 4/2007 Han ..... F25D 17/065 62/340
2009/0019880 A1 * 1/2009 Lee ..... F25C 1/10 62/73
2011/0192175 A1 * 8/2011 Kuratani ..... F25C 5/06 62/349
2011/0219789 A1 * 9/2011 Grosse ..... F25C 5/02 62/73
2012/0096872 A1 * 4/2012 Cheong ..... F25D 23/025 62/340
2013/0014535 A1 * 1/2013 Son ..... F25C 1/10 62/340
2013/0014536 A1 1/2013 Son et al.
2013/0327074 A1 * 12/2013 Lee ..... F25C 1/04 62/177
2014/0165598 A1 * 6/2014 Boarman ..... F25C 1/22 62/347
2014/0165599 A1 * 6/2014 Boarman ..... F25B 21/02 62/3.3
2014/0165620 A1 * 6/2014 Culley ..... F25C 1/18 62/71
2014/0182325 A1 * 7/2014 Lee ..... F25C 5/08 62/340
2015/0107275 A1 * 4/2015 Papalia ..... F25C 1/04 62/340
2016/0138844 A1 * 5/2016 Boarman ..... F25C 1/10 62/3.63
2016/0370085 A1 * 12/2016 Kim ..... F25C 1/20
2019/0293335 A1 * 9/2019 Bertolini ..... F25C 1/04

FOREIGN PATENT DOCUMENTS

JP 2001221545 A * 8/2001
JP 2004183931 A * 7/2004
JP 2017020685 1/2017
KR 20080023426 A * 3/2008
KR 20110037609 A * 2/2011
KR 20110037609 4/2011
KR 20130009332 1/2013
KR 10-2013-0036421 A 4/2013
KR 20160026012 3/2016
KR 101643635 B1 * 7/2016
KR 10-1850918 5/2018

OTHER PUBLICATIONS

JP-2001221545-A, machine translation (Year: 2023).*
Extended European Search Report in European Appln. No. 19209294.8, dated Apr. 17, 2020, 7 pages.
Office Action in Korean Appln. No. 20180142057, mailed on Jul. 12, 2023, 7 pages (with English Translation).
Notice of Allowance in Korean Appln. No. 10-2018-0142057, mailed on Jan. 19, 2024, 7 pages (with English translation).
Extended European Search Report in European Appln. No. 24151852.1, mailed on Nov. 8, 2024, 10 pages.
Office Action in Korean Appln. No. 10-2024-0052984, mailed on Jan. 2, 2025, 5 pages.

* cited by examiner

ICE MAKER AND REFRIGERATOR

CROSS-REFERENCE TO RELATED APPLICATIONS

This application claims the benefit of priority to Korean Application No. 10-10-2018-0142057, filed on Nov. 16, 2018. The disclosure of the prior application is incorporated by reference in its entirety.

BACKGROUND

The present disclosure relates to an ice maker and a refrigerator.

In general, refrigerators are home appliances for storing foods at a low temperature in a storage space that is covered by a door.

The refrigerator may cool the inside of the storage space by using cold air to store the stored food in a refrigerated or frozen state.

Generally, an ice maker for making ice is provided in the refrigerator.

The ice maker is constructed so that water supplied from a water supply source or a water tank is accommodated in a tray to make ice.

Also, the ice maker is constructed to transfer the made ice from the ice tray in a heating manner or twisting manner.

As described above, the ice maker through which water is automatically supplied, and the ice automatically transferred may be opened upward so that the mode ice is pumped up.

As described above, the ice made in the ice maker may have at least one flat surface such as crescent or cubic shape.

When the ice has a spherical shape, it is more convenient to ice the ice, and also, it is possible to provide different feeling of use to a user. Also, even when the made ice is stored, a contact area between the ice cubes may be minimized to minimize a mat of the ice cubes.

Korean Patent No. 10-1850918 as Prior Art document discloses an ice maker.

The ice maker of the prior art document comprises an upper tray having multiple upper cells in a hemisphere form arranged thereon and including a pair of link guide parts extending from both side ends to an upper side; a lower tray having multiple lower cells in a hemisphere form arranged thereon and rotatably connected to the upper tray; a rotary shaft connected to rear ends of the upper tray and the lower tray to rotate the lower tray relative the upper tray; a pair of links wherein one end is connected to the lower tray, and the other end is connected to the link guide part; and an upper ejecting pin assembly configured to ascend and descend with the pair of links, wherein both ends are respectively connected to the pair of links in a state of being inserted into the pair of link guide parts.

In the upper tray, a connection unit connected to the rotary shaft is formed.

In the case of the prior art document, since the upper tray includes the link guide parts and the connection unit simultaneously with forming the upper cells, there is a disadvantage that a structure of the upper tray is complicated.

In addition, it is much apprehended that the upper tray will be damaged or deformed because the upper tray receives an expansive force of water, a rotational force of the lower tray and a transfer force of the link, which is caused by the making of the ice.

If the upper tray is deformed at one time, it is not possible to make sphere-like ice.

SUMMARY

The present embodiment provides an ice maker for preventing a gap between an upper tray and a lower tray from being widened.

The present embodiment provides an ice maker for preventing plastic deformation of each of the upper tray and the lower tray, as each of the upper tray and the lower tray is formed of a silicone material.

The present embodiment provides a refrigerator including the above-described ice maker.

The ice maker according to one aspect comprises: an upper tray including an upper tray body defining an upper chamber that is a portion of an ice chamber for generating ice; and a lower tray rotated relative to the upper tray based on a rotational center, and including a lower tray body defining a lower chamber that is another portion of the ice chamber.

A top surface of the lower tray body can contact a bottom surface of the upper tray body. The rotational center may be disposed outside of the upper chamber and the lower chamber.

The bottom surface of the upper tray body may include a first surface and a second surface disposed farther from the rotational center than the first surface. Before the top surface of the lower tray body contacts the bottom surface of the upper tray body, the second surface may be lower than the first surface.

The first surface is a surface closest to the rotational center, and the second surface is a surface farthest to the rotational center. The bottom surface of the upper tray body may be inclined downward as the first surface goes farther to the second surface.

Each of the first surface and the second surface may be a horizontal surface or an inclined surface.

When the lower tray body is rotated to be close to the upper tray body based on the rotational center, the top surface of the lower tray body may contact the first surface and the second surface of the upper tray body before the top surface of the lower tray body is horizontal.

The lower tray body may be additionally rotated in a state that the bottom surface of the lower tray body contacts the first surface and the second surface of the upper tray body.

Each of the upper tray and the lower tray may be a flexible material or a silicone material.

Each of the upper chamber and the lower chamber is formed in a hemisphere form.

The ice maker may further comprise: an upper case supporting the upper tray; and a lower supporter supporting the lower tray and rotatably connected to the upper case. The rotational center is a center of a hinge body for rotation of the lower supporter.

The ice maker may further comprise a lower heater installed in the lower supporter and contacting the lower tray.

The lower tray further comprises a circumferential wall extending from the lower tray body and surrounding the upper tray.

The circumferential wall comprises a second wall disposed adjacent to the first surface and having a curved shape, and a first wall disposed adjacent to the second surface and extending in a vertical direction.

A refrigerator according to another aspect comprises: a storage space in which foods are stored; and an ice maker for generating ice by cold air of the storage space, wherein the ice maker comprises: an upper tray including an upper tray body defining an upper chamber that is a portion of an ice chamber for generating ice; and a lower tray rotated relative to the upper tray based on a rotational center, and including a lower tray body defining a lower chamber that is another portion of the ice chamber.

A top surface of the lower tray body can contact a bottom surface of the upper tray body. The bottom surface of the upper tray body may include a first surface and a second surface disposed farther from the rotational center than the first surface.

Before the top surface of the lower tray body contacts the bottom surface of the upper tray body, the second surface may be lower than the first surface. Each of the first surface and the second surface may be a horizontal surface or an inclined surface.

The first surface is a surface closest to the rotational center, and the second surface is a surface farthest to the rotational center, and the bottom surface of the upper tray body is inclined downward as the first surface goes farther to the second surface.

Each of the upper tray and the lower tray may be formed of a flexible material or a silicone material.

DETAILED DESCRIPTION OF THE EMBODIMENTS

Figure 1:
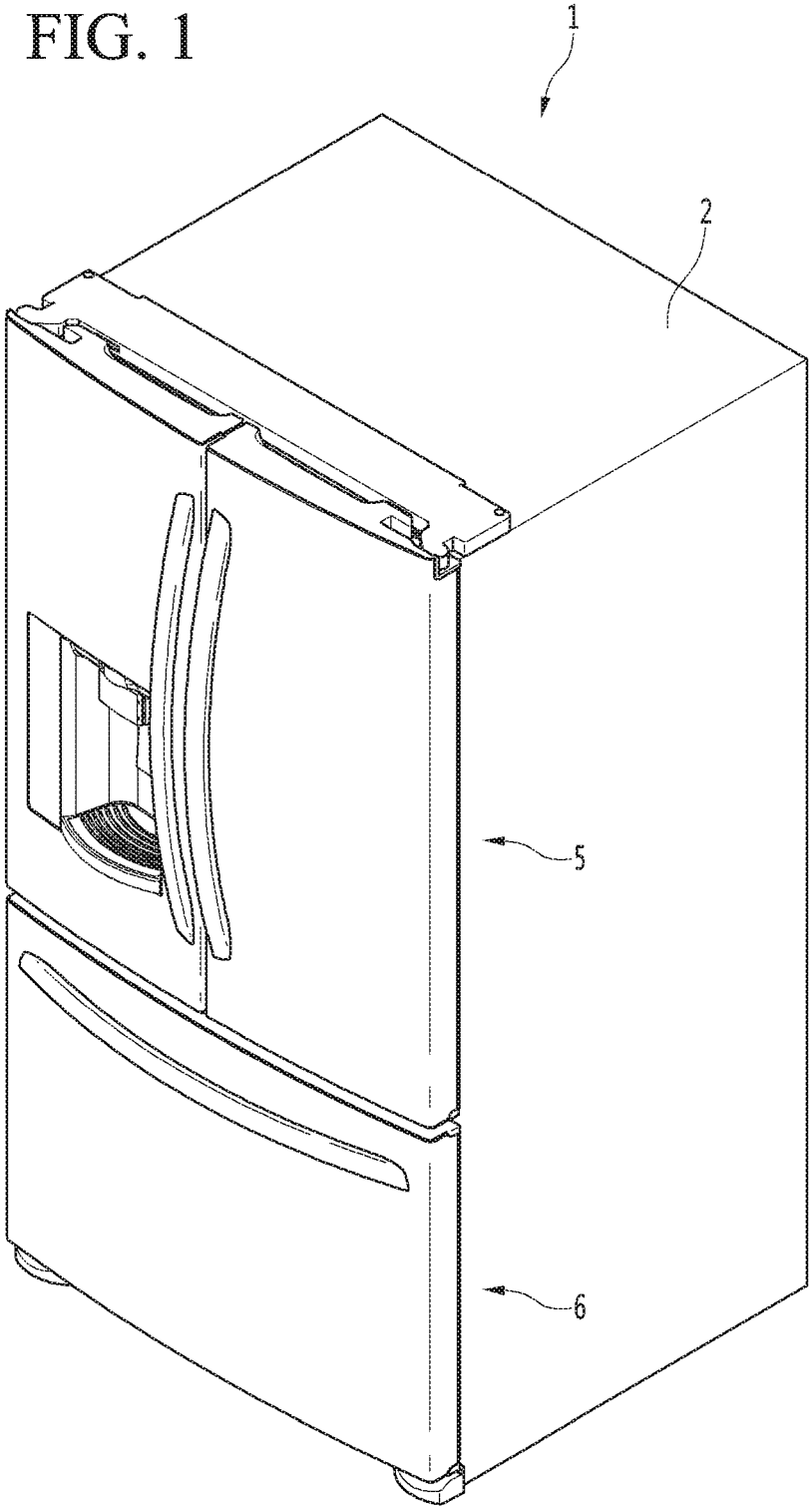
FIG. 1 is a perspective view of a refrigerator according to one embodiment of the present disclosure.
Figure 2:
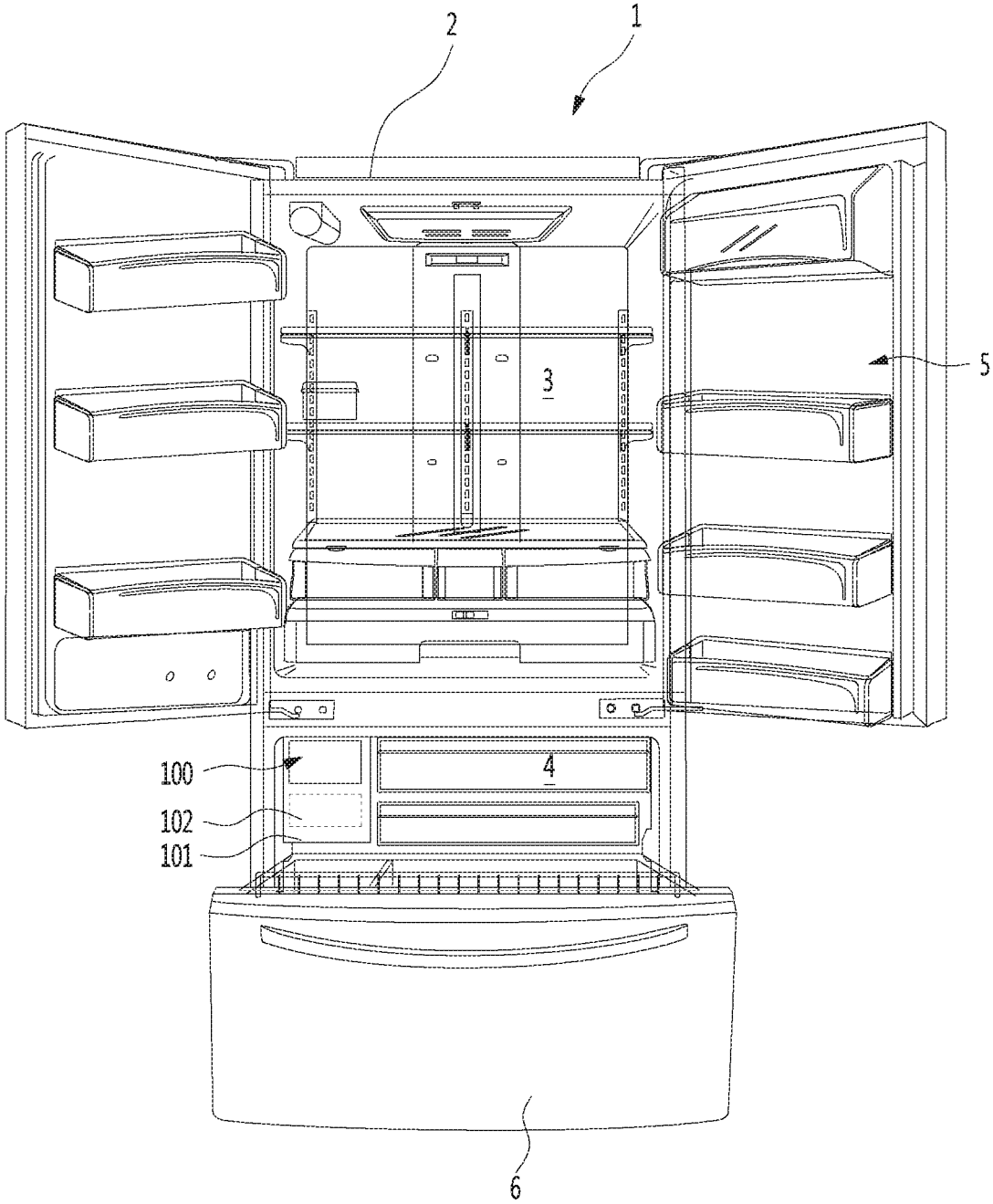
FIG. 2 is a view showing a state in which a door of the refrigerator of FIG. 1 is opened.

FIG. 1 is a perspective view of a refrigerator according to an embodiment, and FIG. 2 is a view illustrating a state in which a door of the refrigerator of FIG. 1 is opened.

Referring to FIGS. 1 and 2, a refrigerator 1 according to an embodiment may include a cabinet 2 defining a storage space and a door that opens and closes the storage space.

In detail, the cabinet 2 may define the storage space that is vertically divided by a barrier. Here, a refrigerating compartment 3 may be defined at an upper side, and a freezing compartment 4 may be defined at a lower side.

Accommodation members such as a drawer, a shelf, a basket, and the like may be provided in the refrigerating compartment 3 and the freezing compartment 4.

The door may include a refrigerating compartment door 5 opening/closing the refrigerating compartment 3 and a freezing compartment door 6 opening/closing the freezing compartment 4.

The refrigerating compartment door 5 may be constituted by a pair of left and right doors and be opened and closed through rotation thereof. Also, the freezing compartment door 6 may be inserted and withdrawn in a drawer manner.

Alternatively, the arrangement of the refrigerating compartment 3 and the freezing compartment 4 and the shape of the door may be changed according to kinds of refrigerators, but are not limited thereto. For example, the embodiments may be applied to various kinds of refrigerators. For example, the freezing compartment 4 and the refrigerating compartment 3 may be disposed at left and right sides, or the freezing compartment 4 may be disposed above the refrigerating compartment 3.

An ice maker 100 may be provided in the freezing compartment 4. The ice maker 100 is constructed to make ice by using supplied water. Here, the ice may have a spherical shape.

Also, an ice bin 102 in which the ice is stored after being transferred from the ice maker 100 may be further provided below the ice maker 100.

The ice maker 100 and the ice bin 102 may be mounted in the freezing compartment 4 in a state of being respectively mounted in separate housings 101.

A user may open the refrigerating compartment door 6 to approach the ice bin 102, thereby obtaining the ice.

In another example, a dispenser 7 for dispensing purified water or the made ice to the outside may be provided in the refrigerating compartment door 5.

Also, the ice made in the ice maker 100 or the ice stored in the ice bin 102 after being made in the ice maker 100 may be transferred to the dispenser 7 by a transfer unit. Thus, the user may obtain the ice from the dispenser 7.

Hereinafter, the ice maker will be described in detail with reference to the accompanying drawings.

Figure 3:
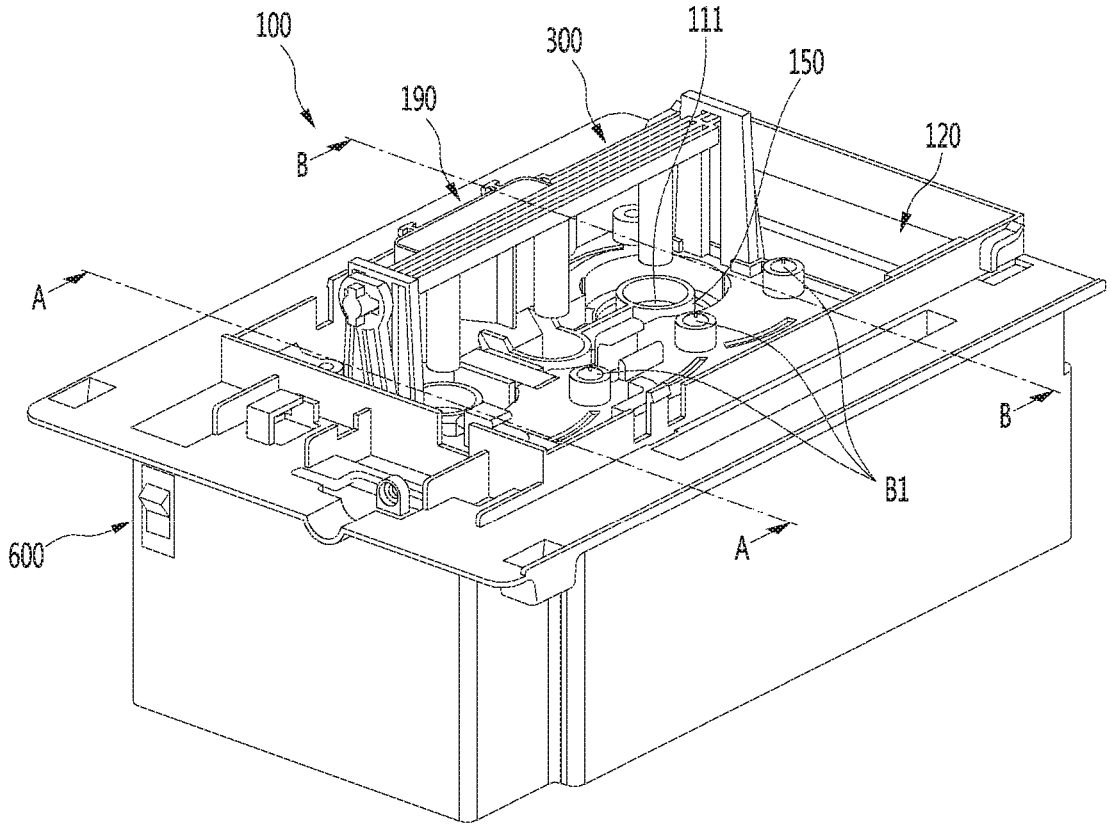
FIG. 3 and FIG. 4 is a perspective view of an ice maker according to one embodiment of the present disclosure.
Figure 4:
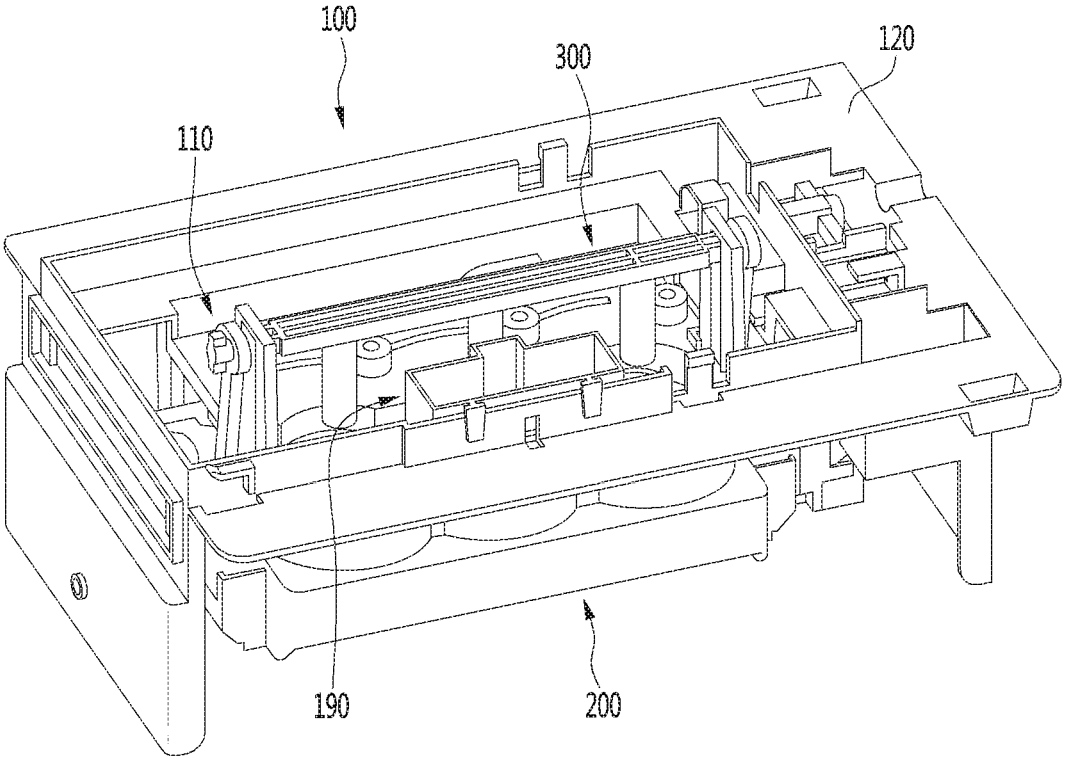
Figure 5:
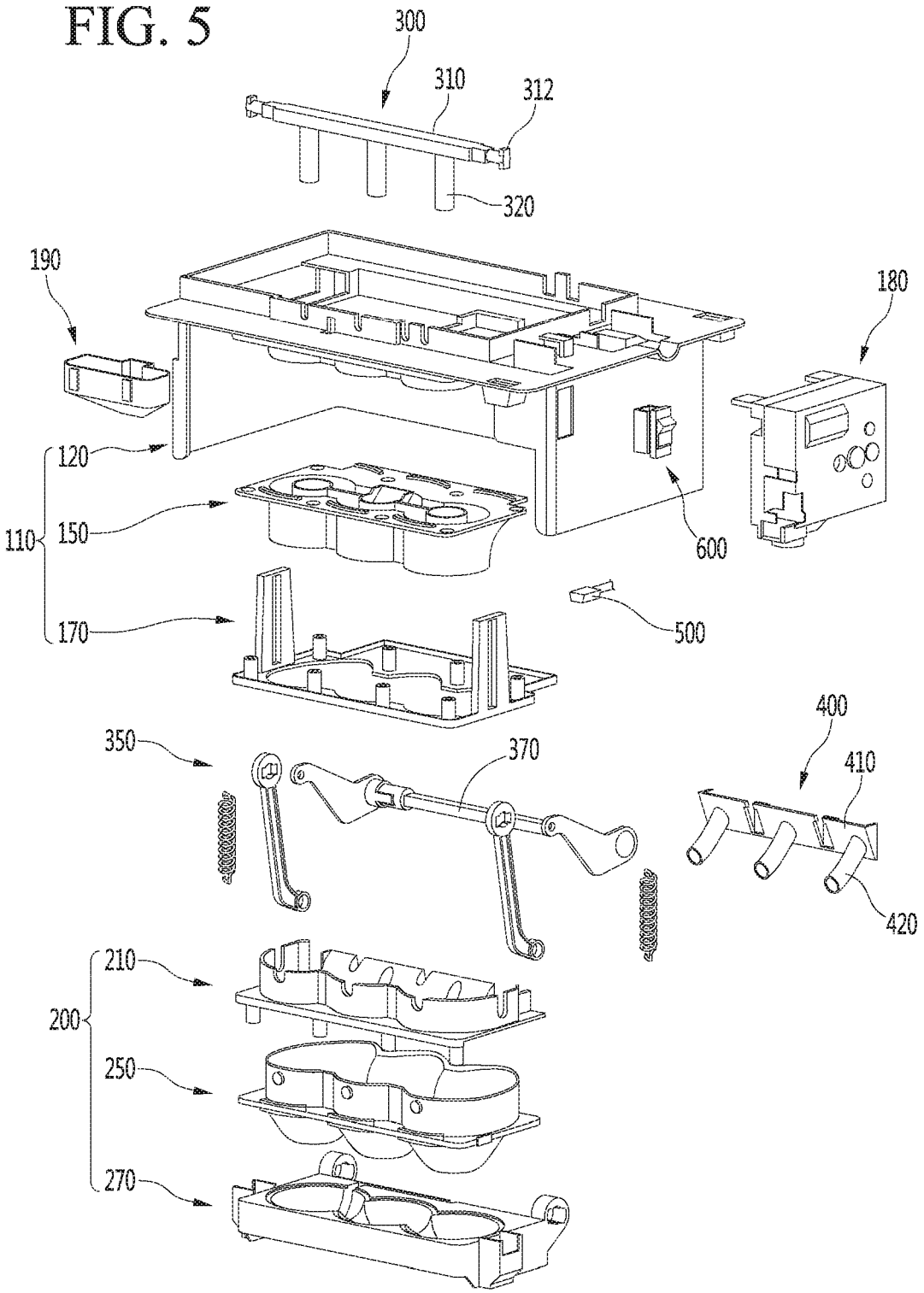
FIG. 5 is an exploded perspective view of an ice maker according to one embodiment of the present disclosure.

FIGS. 3 and 4 are perspective views of the ice maker according to an embodiment, and FIG. 5 is an exploded perspective view of the ice maker according to an embodiment.

Referring to FIGS. 3 to 5, the ice maker 100 may include an upper assembly 110 and a lower assembly 200.

The lower assembly 200 may rotate with respect to the upper assembly 110. For example, the lower assembly 200 may be connected to be rotatable with respect to the upper assembly 110.

In a state in which the lower assembly 200 contacts the upper assembly 110, the lower assembly 200 together with the upper assembly 110 may make spherical ice.

That is, the upper assembly 110 and the lower assembly 200 may define an ice chamber 111 for making the spherical ice. The ice chamber 111 may have a chamber having a substantially spherical shape.

As used herein, a term "spherical or hemisphere form" not only includes a geometrically complete sphere or hemisphere form but also a geometrically complete sphere-like or geometrically complete hemisphere-like form.

The upper assembly 110 and the lower assembly 200 may define a plurality of ice chambers 111.

Hereinafter, a structure in which three ice chambers are defined by the upper assembly 110 and the lower assembly 200 will be described as an example, and also, the embodiments are not limited to the number of ice chambers 111.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driving unit 180 so that the lower assembly 200 is rotatable with respect to the upper assembly 110.

The driving unit 180 may include a driving motor and a power transmission part for transmitting power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

The upper ejector 300 may be constructed so that the ice closely attached to the upper assembly 110 is separated from the upper assembly 110.

The upper ejector 300 may include an ejector body 310 and a plurality of upper ejecting pins 320 extending in a direction crossing the ejector body 310.

The upper ejecting pins 320 may be provided in the same number of ice chambers 111.

A separation prevention protrusion 312 for preventing a connection unit 350 from being separated in the state of being coupled to the connection unit 350 that will be described later may be provided on each of both ends of the ejector body 310.

For example, the pair of separation prevention protrusions 312 may protrude in opposite directions from the ejector body 310.

While the upper ejecting pin 320 passing through the upper assembly 110 and inserted into the ice chamber 111, the ice within the ice chamber 111 may be pressed.

The ice pressed by the upper ejecting pin 320 may be separated from the upper assembly 110.

Also, the ice maker 100 may further include a lower ejector 400 so that the ice closely attached to the lower assembly 200 is capable of being separated.

The lower ejector 400 may press the lower assembly 200 to separate the ice closely attached to the lower assembly 200 from the lower assembly 200. For example, the lower ejector 400 may be fixed to the upper assembly 110.

The lower ejector 400 may include an ejector body 410 and a plurality of lower ejecting pins 420 protruding from the ejector body 410. The lower ejecting pins 420 may be provided in the same number of ice chambers 111.

While the lower assembly 200 rotates to transfer the ice, rotation force of the lower assembly 200 may be transmitted to the upper ejector 300.

For this, the ice maker 100 may further include the connection unit 350 connecting the lower assembly 200 to the upper ejector 300. The connection unit 350 may include one or more links.

For example, when the lower assembly 200 rotates in one direction, the upper ejector 300 may descend by the connection unit 350 to allow the upper ejector pin 320 to press the ice.

On the other hand, when the lower assembly 200 rotates in the other direction, the upper ejector 300 may ascend by the connection unit 350 to return to its original position.

Hereinafter, the upper assembly 110 and the lower assembly 120 will be described in more detail.

The upper assembly 110 may include an upper tray 150 defining a portion of the ice chamber 111 making the ice. For example, the upper tray 150 may define an upper portion of the ice chamber 111.

The upper assembly 110 may further include an upper support 170 fixing a position of the upper tray 150 and an upper case 120 fixing a position of the upper tray 150.

The upper tray 150 may be disposed below the upper case 120. A portion of the upper support 170 may be disposed below the upper tray 150.

As described above, the upper case 120, the upper tray 150, and the upper support 170, which are vertically aligned, may be coupled to each other through a coupling member.

That is, the upper tray 150 may be fixed to the upper case 120 through coupling of the coupling member.

The upper support 170 may restrict downward movement of the upper tray 150.

For example, the water supply part 190 may be fixed to the upper case 120.

The ice maker 100 may further include a temperature sensor 500 detecting a temperature of the ice chamber 111.

In one example, the temperature sensor 500 detects the temperature of the upper tray 150 thus to indirectly detect the temperature of the water or the temperature of the ice in the ice chamber 111.

For example, the temperature sensor 500 may be mounted on the upper case 120. Also, when the upper tray 150 is fixed to the upper case 120, the temperature sensor 500 may contact the upper tray 150.

The lower assembly 200 may include a lower tray 250 defining the other portion of the ice chamber 111 making the ice. For example, the lower tray 250 may define a lower portion of the ice chamber 111.

The lower assembly 200 may further include a lower support 270 supporting a lower portion of the lower tray 250.

The lower assembly 200 may further include a lower case 210 of which at least a portion covers an upper side of the lower tray 250.

The lower case 210, the lower tray 250, and the lower support 270 may be coupled to each other through a coupling member.

The ice maker 100 may further include a switch for turning on/off the ice maker 100. When the user turns on the switch 600, the ice maker 100 may make ice.

That is, when the switch 600 is turned on, water may be supplied to the ice maker 100. Then, an ice making process of making ice by using cold air and an ice separating process of transferring the ice through the rotation of the lower assembly 200.

On the other hand, when the switch 600 is manipulated to be turned off, the making of the ice through the ice maker 100 may be impossible. For example, the switch 600 may be provided in the upper case 120.

<Upper Case>

Figure 6:
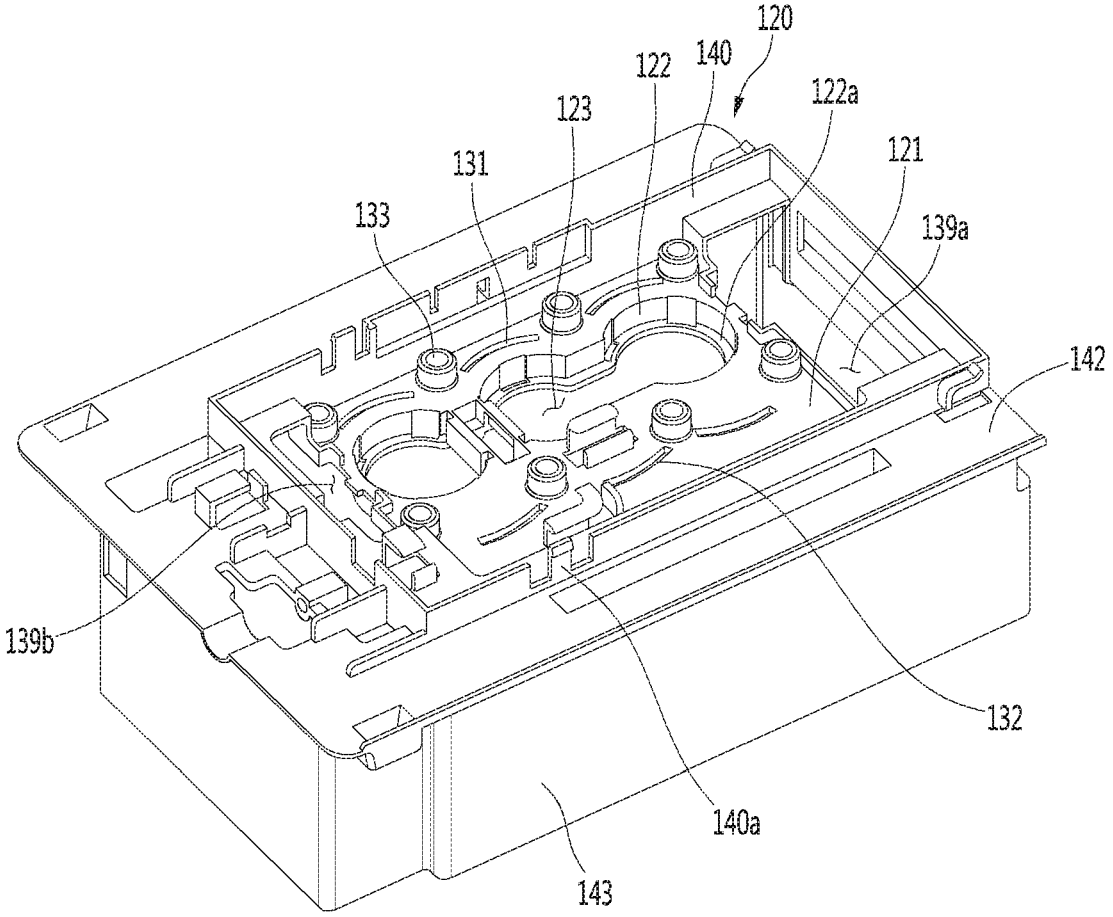
FIG. 6 is a top perspective view of an upper case according to one embodiment of the present disclosure.
Figure 7:
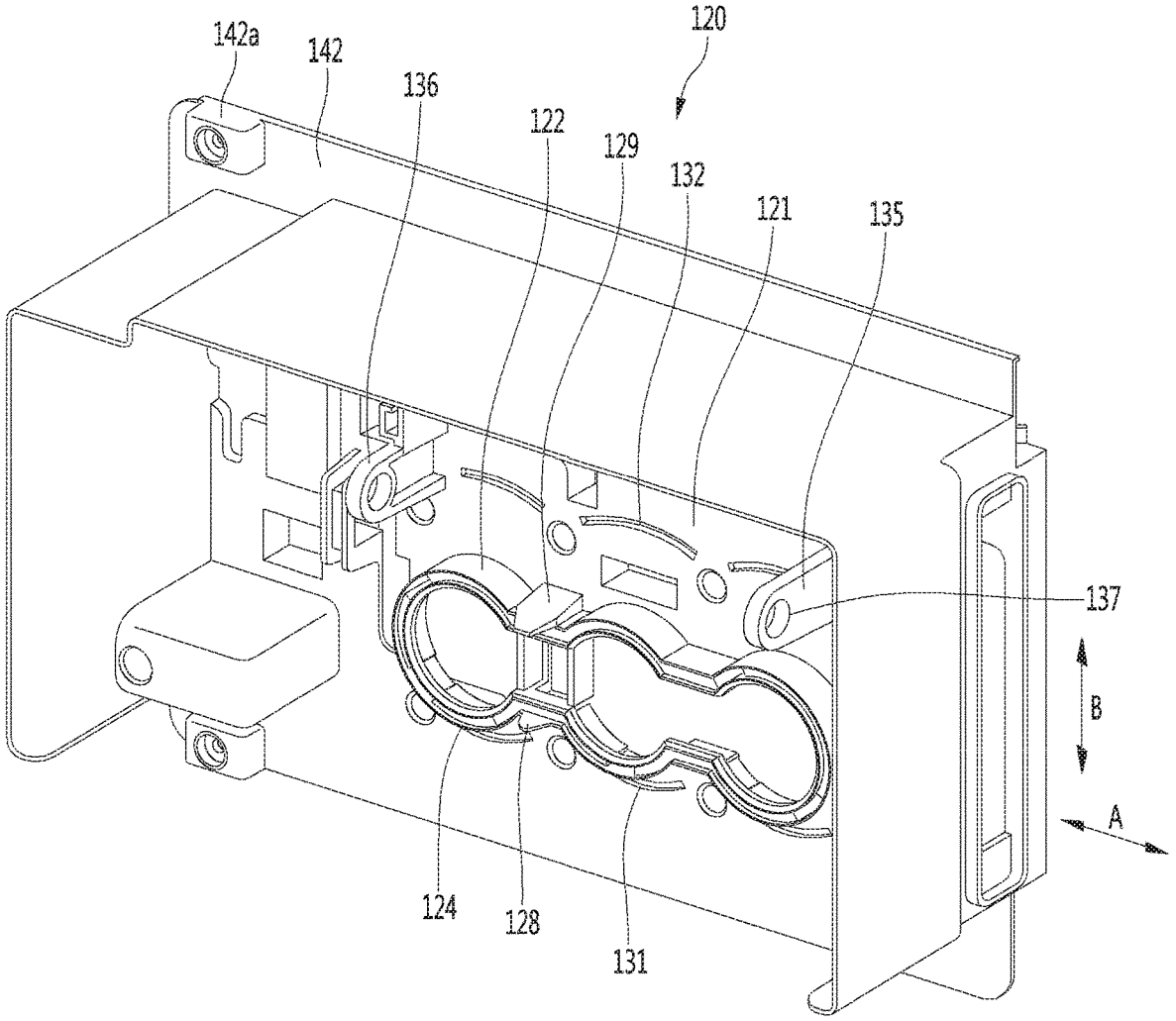
FIG. 7 is a bottom perspective view of an upper case according to one embodiment of the present disclosure.

FIG. 6 is a top perspective view of the upper case according to an embodiment, and FIG. 7 is a bottom perspective view of the upper case according to an embodiment.

Referring to FIGS. 6 and 7, the upper case 120 may be fixed to a housing 101 within the freezing compartment 4 in a state in which the upper tray 150 is fixed.

The upper case 120 may include an upper plate for fixing the upper tray 150.

The upper tray 150 may be fixed to the upper plate 121 in a state in which a portion of the upper tray 150 contacts a bottom surface of the upper plate 121.

An opening 123 through which a portion of the upper tray 150 passes may be defined in the upper plate 121.

For example, when the upper tray 150 is fixed to the upper plate 121 in a state in which the upper tray 150 is disposed below the upper plate 121, a portion of the upper tray 150 may protrude upward from the upper plate 121 through the opening 123.

Alternatively, the upper tray 150 may not protrude upward from the upper plate 121 through opening 123 but protrude downward from the upper plate 121 through the opening 123.

The upper plate 121 may include a recess 122 that is recessed downward. The opening 123 may be defined in a bottom surface 122*a* of the recess 122.

Thus, the upper tray 150 passing through the opening 123 may be disposed in a space defined by the recess 122.

A heater coupling part 124 for coupling an upper heater (see reference numeral 148 of FIG. 13) that heats the upper tray 150 so as to transfer the ice may be provided in the upper case 120.

For example, the heater coupling part 124 may be provided on the upper plate 121. The heater coupling part 124 may be disposed below the recess 122.

The upper case 120 may further include a plurality of installation ribs 128 and 129 for installing the temperature sensor 500.

The pair of installation ribs 128 and 129 may be disposed to be spaced apart from each other in a direction of an arrow B of FIG. 7. The pair of installation ribs 128 and 129 may be disposed to face each other, and the temperature sensor 500 may be disposed between the pair of installation ribs 128 and 129.

The pair of installation ribs 128 and 129 may be provided on the upper plate 121.

A plurality of slots 131 and 132 coupled to the upper tray 150 may be provided in the upper plate 121.

A portion of the upper tray 150 may be inserted into the plurality of slots 131 and 132.

The plurality of slots 131 and 132 may include a first upper slot 131 and a second upper slot 132 disposed at an opposite side of the first upper slot 131 with respect to the opening 123.

The opening 123 may be defined between the first upper slot 131 and the second upper slot 132.

The first upper slot 131 and the second upper slot 132 may be spaced apart from each other in a direction of an arrow B of FIG. 7.

Although not limited, the plurality of first upper slots 131 may be arranged to be spaced apart from each other in a direction of an arrow A (hereinafter, referred to as a first direction) that a direction crossing a direction of an arrow B (hereinafter, referred to as a second direction).

Also, the plurality of second upper slots 132 may be arranged to be spaced apart from each other in the direction of the arrow A.

In this specification, the direction of the arrow A may be the same direction as the arranged direction of the plurality of ice chambers 111.

For example, the first upper slot 131 may be defined in a curved shape. Thus, the first upper slot 131 may increase in length.

For example, the second upper slot 132 may be defined in a curved shape. Thus, the second upper slot 133 may increase in length.

When each of the upper slots 131 and 132 increases in length, a protrusion (that is disposed on the upper tray) inserted into each of the upper slots 131 and 132 may increase in length to improve coupling force between the upper tray 150 and the upper case 120.

A distance between the first upper slot 131 and the opening 123 may be different from that between the second upper slot 132 and the opening 123. For example, the distance between the first upper slot 131 and the opening 123 may be greater than that between the second upper slot 132 and the opening 123.

Also, when viewed from the opening 123 toward each of the upper slots 131, a shape that is convexly rounded from each of the slots 131 toward the outside of the opening 123 may be provided.

The upper plate 121 may further include a sleeve 133 into which a coupling boss of the upper support, which will be described later, is inserted.

The sleeve 133 may have a cylindrical shape and extend upward from the upper plate 121.

For example, a plurality of sleeves 133 may be provided on the upper plate 121. The plurality of sleeves 133 may be arranged to be spaced apart from each other in the direction of the arrow A. Also, the plurality of sleeves 133 may be arranged in a plurality of rows in the direction of the arrow B.

A portion of the plurality of sleeves may be disposed between the two first upper slots 131 adjacent to each other.

The other portion of the plurality of sleeves may be disposed between the two second upper slots 132 adjacent to each other or be disposed to face a region between the two second upper slots 132.

The upper case 120 may further include a plurality of hinge supports 135 and 136 allowing the lower assembly 200 to rotate.

The plurality of hinge supports 135 and 136 may be disposed to be spaced apart from each other in the direction of the arrow A with respect to FIG. 7. Also, a first hinge hole 137 may be defined in each of the hinge supports 135 and 136.

For example, the plurality of hinge supports 135 and 136 may extend downward from the upper plate 121.

The upper case 120 may further include a vertical extension part 140 vertically extending along a circumference of the upper plate 121. The vertical extension part 140 may extend upward from the upper plate 121.

The vertical extension part 140 may include one or more coupling hooks 140*a*. The upper case 120 may be hook-coupled to the housing 101 by the coupling hooks 140*a*.

The water supply part 190 may be coupled to the vertical extension part 140.

The upper case 120 may further include a horizontal extension part 142 horizontally extending to the outside of the vertical extension part 140.

A screw coupling part 142*a* protruding outward to screw-couple the upper case 120 to the housing 101 may be provided on the horizontal extension part 142.

The upper case 120 may further include a side circumferential part 143. The side circumferential part 143 may extend downward from the horizontal extension part 142.

The side circumferential part 143 may be disposed to surround a circumference of the lower assembly 200. That is, the side circumferential part 143 may prevent the lower assembly 200 from being exposed to the outside.

Although the upper case is coupled to the separate housing 101 within the freezing compartment 4 as described above, the embodiment is not limited thereto. For example, the upper case 120 may be directly coupled to a wall defining the freezing compartment 4.

<Upper Tray>

Figure 8:
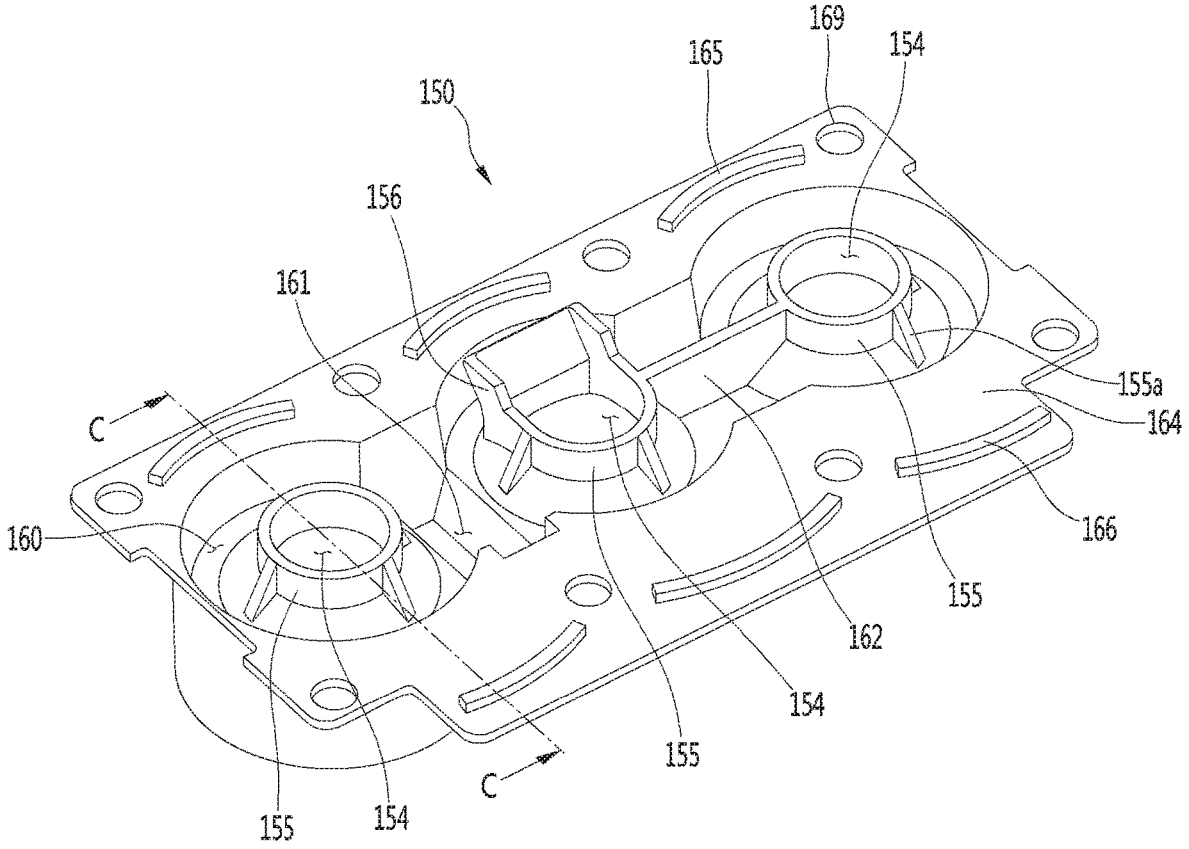
FIG. 8 is a top perspective view of an upper tray according to one embodiment of the present disclosure.
Figure 9:
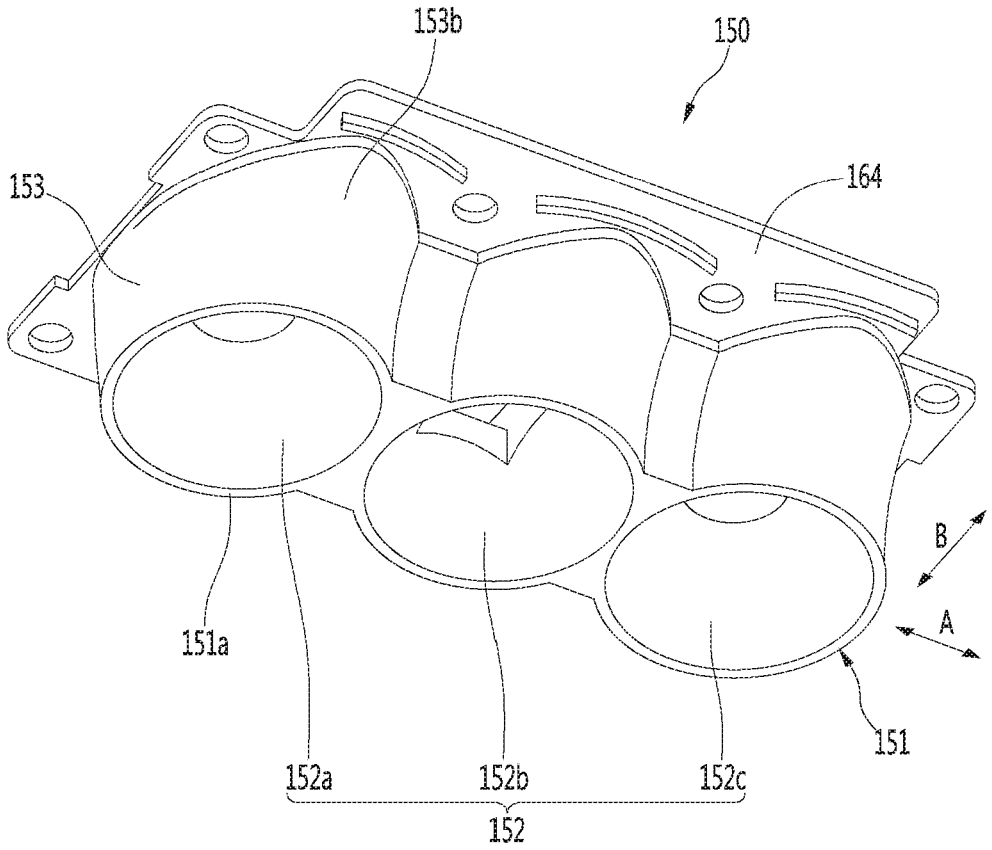
FIG. 9 is a bottom perspective view of an upper tray according to one embodiment of the present disclosure.
Figure 10:
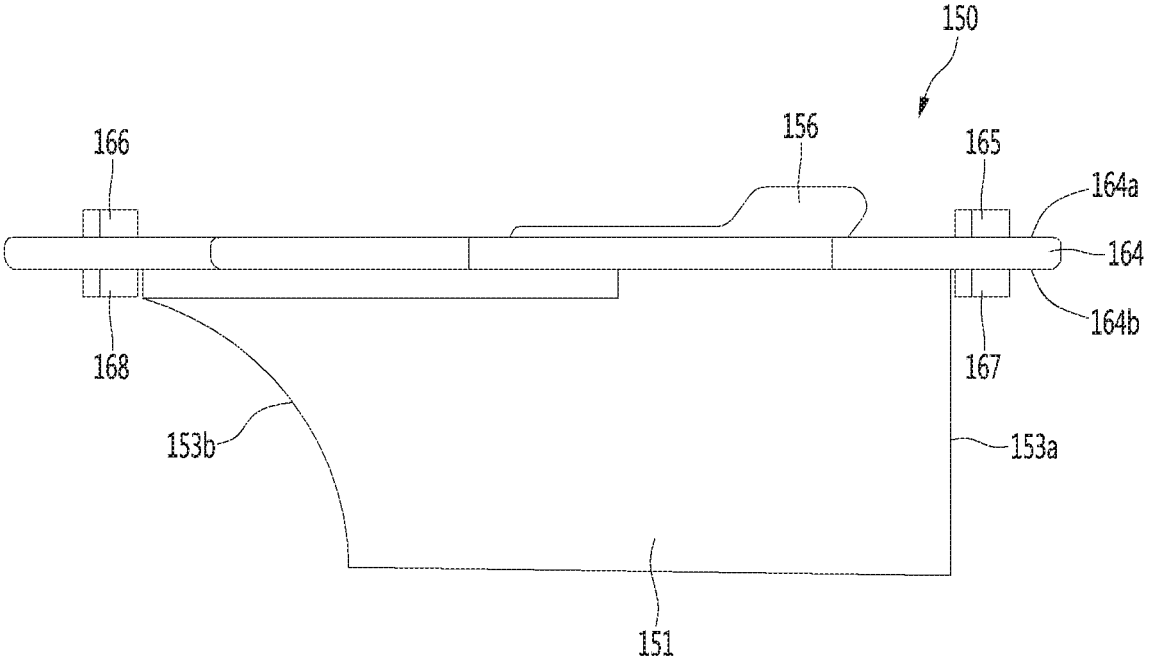
FIG. 10 is a side elevation view of an upper tray according to one embodiment of the present disclosure.
Figure 11:
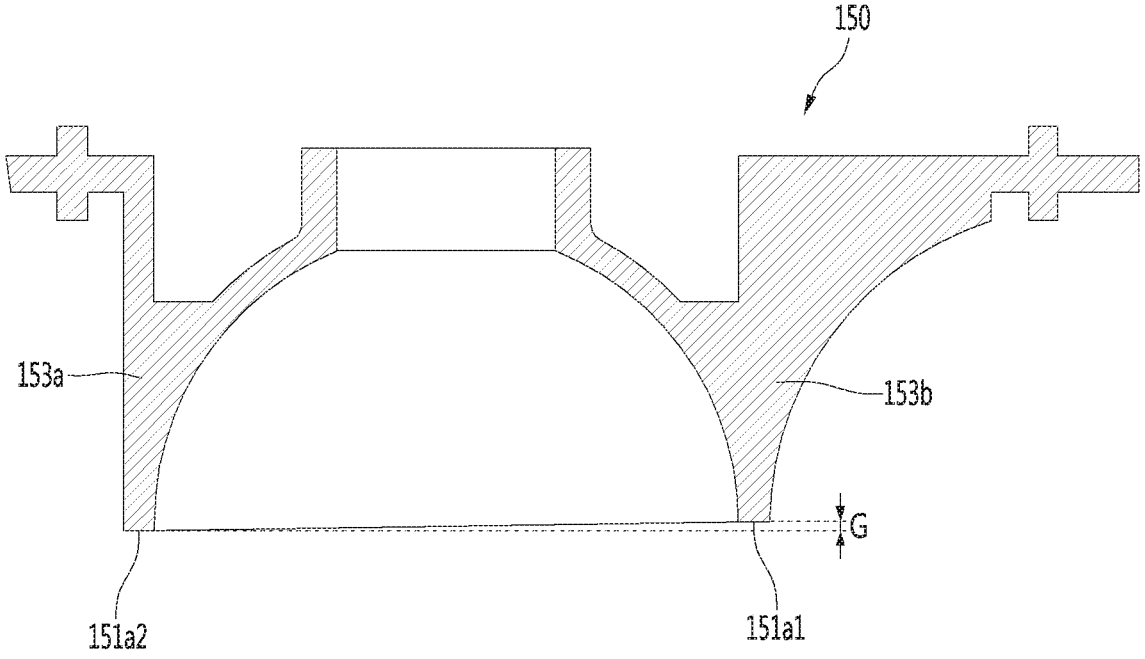
FIG. 11 is a cross-sectional taken along line C-C of FIG. 8.

FIG. 8 is a top perspective view of the upper tray according to an embodiment, FIG. 9 is a bottom perspective view of the upper tray according to an embodiment, FIG. 10 is a side view of the upper tray according to an embodiment, and FIG. 11 is a cross-sectional taken along line C-C of FIG. 8.

Referring to FIGS. 8 to 11, the upper tray 150 may be made of a non-metal material and a flexible material that is capable of being restored to its original shape after being deformed by an external force.

For example, the upper tray 150 may be made of a silicone material. Like this embodiment, when the upper tray 150 is made of the silicone material, even though external force is applied to deform the upper tray 150 during the ice separating process, the upper tray 150 may be restored to its original shape. Thus, in spite of repetitive ice making, spherical ice may be made.

If the upper tray 150 is made of a metal material, when the external force is applied to the upper tray 150 to deform the upper tray 150 itself, the upper tray 150 may not be restored to its original shape any more.

In this case, after the upper tray 150 is deformed in shape, the spherical ice may not be made. That is, it is impossible to repeatedly make the spherical ice.

On the other hand, like this embodiment, when the upper tray 150 is made of the flexible material that is capable of being restored to its original shape, this limitation may be solved.

Also, when the upper tray 150 is made of the silicone material, the upper tray 150 may be prevented from being melted or thermally deformed by heat provided from an upper heater that will be described later.

The upper tray 150 may include an upper tray body 151 defining an upper chamber 152 that is a portion of the ice chamber 111.

The upper tray body 151 may be define a plurality of upper chambers 152.

For example, the plurality of upper chambers 152 may define a first upper chamber 152*a*, a second upper chamber 152*b*, and a third upper chamber 152*c*.

The upper tray body 151 may include three chamber walls 153 defining three independent upper chambers 152*a*, 152*b*, and 152*c*. The three chamber walls 153 may be connected to each other to form one body.

The first upper chamber 152*a*, the second upper chamber 152*b*, and the third upper chamber 152*c* may be arranged in a line. For example, the first upper chamber 152*a*, the second upper chamber 152*b*, and the third upper chamber 152*c* may be arranged in a direction of an arrow A with respect to FIG. 9. The direction of the arrow A of FIG. 9 may be the same direction as the direction of the arrow A of FIG. 7.

The upper chamber 152 may have a hemispherical shape. That is, an upper portion of the spherical ice may be made by the upper chamber 152.

An upper opening 154 may be defined in an upper side of the upper tray body 151.

For example, three upper openings 154 may be defined in the upper tray body 151.

Cold air may be guided into the ice chamber 111 through the upper opening 154. Further, water may be supplied through the upper opening 154.

In the ice separating process, the upper ejector 300 may be inserted into the upper chamber 152 through the upper opening 154.

While the upper ejector 300 is inserted through the upper opening 154, an inlet wall 155 may be provided on the upper tray 150 to minimize deformation of the upper opening 154 in the upper tray 150.

The inlet wall 155 may be disposed along a circumference of the upper opening 154 and extend upward from the upper tray body 151.

The inlet wall 155 may have a cylindrical shape. Thus, the upper ejector 30 may pass through the upper opening 154 via an inner space of the inlet wall 155.

One or more first connection ribs 155*a* may be provided along a circumference of the inlet wall 155 to prevent the inlet wall 155 from being deformed while the upper ejector 300 is inserted into the upper opening 154.

The first connection rib 155*a* may connect the inlet wall 155 to the upper tray body 151. For example, the first connection rib 155*a* may be integrated with the circumference of the inlet wall 155 and an outer face of the upper tray body 151.

Although not limited, the plurality of connection ribs 155*a* may be disposed along the circumference of the inlet wall 155.

The two inlet walls 155 corresponding to the second upper chamber 152*b* and the third upper chamber 152*c* may be connected to each other through the second connection rib 162. The second connection rib 162 may also prevent the inlet wall 155 from being deformed.

A water supply guide 156 may be provided in the inlet wall 155 corresponding to one of the three upper chambers 152*a*, 152*b*, and 152*c*.

Although not limited, the water supply guide 156 may be provided in the inlet wall corresponding to the second upper chamber 152*b*.

The water supply guide 156 may be inclined upward from the inlet wall 155 in a direction which is away from the second upper chamber 152*b*.

The upper tray 150 may further include a first accommodation part 160. The recess 122 of the upper case 120 may be accommodated in the first accommodation part 160.

A heater coupling part 124 may be provided in the recess 122, and an upper heater (see reference numeral 148 of FIG. 14) may be provided in the heater coupling part 124. Thus, it may be understood that the upper heater (see reference numeral 148 of FIG. 14) is accommodated in the first accommodation part 160.

The first accommodation part 160 may be disposed in a shape that surrounds the upper chambers 152*a*, 152*b*, and 152*c*. The first accommodation part 160 may be provided by recessing a top surface of the upper tray body 151 downward.

The heater coupling part 124 to which the upper heater (see reference numeral 148 of FIG. 14) is coupled may be accommodated in the first accommodation part 160.

The upper tray 150 may further include a second accommodation part 161 (or referred to as a sensor accommodation part) in which the temperature sensor 500 is accommodated.

For example, the second accommodation part 161 may be provided in the upper tray body 151. Although not limited, the second accommodation part 161 may be provided by recessing a bottom surface of the first accommodation part 160 downward.

Also, the second accommodation part 161 may be disposed between the two upper chambers adjacent to each other. For example, the second accommodation part 161 may be disposed between the first upper chamber 152*a* and the second upper chamber 152*b*.

Thus, an interference between the upper heater (see reference numeral 148 of FIG. 14) accommodated in the first accommodation part 160 and the temperature sensor 500 may be prevented.

In the state in which the temperature sensor 500 is accommodated in the second accommodation part 161, the temperature sensor 500 may contact an outer face of the upper tray body 151.

The chamber wall 153 of the upper tray body 151 may include a vertical wall 153*a* and a curved wall 153*b*.

The curved wall 153*b* may be rounded upward in a direction that is away from the upper chamber 152.

The upper tray 150 may further include a horizontal extension part 164 horizontally extending from the circumference of the upper tray body 151. For example, the horizontal extension part 164 may extend along a circumference of an upper edge of the upper tray body 151.

The horizontal extension part 164 may contact the upper case 120 and the upper support 170.

For example, a bottom surface 164*b* (or referred to as a "first surface") of the horizontal extension part 164 may contact the upper support 170, and a top surface 164*a* (or referred to as a "second surface") of the horizontal extension part 164 may contact the upper case 120.

At least a portion of the horizontal extension part 164 may be disposed between the upper case 120 and the upper support 170.

The horizontal extension part 164 may include a plurality of upper protrusions 165 and 166 respectively inserted into the plurality of upper slots 131 and 132.

The plurality of upper protrusions 165 and 166 may include a first upper protrusion 165 and a second upper protrusion 166 disposed at an opposite side of the first upper protrusion 165 with respect to the upper opening 154.

The first upper protrusion 165 may be inserted into the first upper slot 131, and the second upper protrusion 166 may be inserted into the second upper slot 132.

The first upper protrusion 165 and the second upper protrusion 166 may protrude upward from the top surface 164*a* of the horizontal extension part 164.

The first upper protrusion 165 and the second upper protrusion 166 may be spaced apart from each other in the direction of the arrow B of FIG. 8. The direction of the arrow B of FIG. 8 may be the same direction as the direction of the arrow B of FIG. 7.

Although not limited, the plurality of first upper protrusions 165 may be arranged to be spaced apart from each other in the direction of the arrow A.

The plurality of second upper protrusions 166 may be arranged to be spaced apart from each other in the direction of the arrow A.

For example, the first upper protrusion 165 may be provided in a curved shape. Also, for example, the second upper protrusion 166 may be provided in a curved shape.

In this embodiment, each of the upper protrusions 165 and 166 may be constructed so that the upper tray 150 and the upper case 120 are coupled to each other, and also, the horizontal extension part is prevented from being deformed during the ice making process or the ice separating process.

Here, when each of the upper protrusions 165 and 166 is provided in the curved shape, distances between the upper protrusions 165 and 166 and the upper chamber 152 in a longitudinal direction of the upper protrusions 165 and 166 may be equal or similar to each other to effectively prevent the horizontal extension parts 264 from being deformed.

For example, the deformation in the horizontal direction of the horizontal extension part 264 may be minimized to prevent the horizontal extension part 264 from being plastic-deformed. If when the horizontal extension part 264 is plastic-deformed, since the upper tray body is not positioned at the correct position during the ice making, the shape of the ice may not close to the spherical shape.

The horizontal extension part 164 may further include a plurality of lower protrusions 167 and 168. The plurality of lower protrusions 167 and 168 may be inserted into a lower slot of the upper support 170, which will be described below.

The plurality of lower protrusions 167 and 168 may include a first lower protrusion 167 and a second lower protrusion 168 disposed at an opposite side of the first lower protrusion 167 with respect to the upper chamber 152.

The first lower protrusion 167 and the second lower protrusion 168 may protrude upward from the bottom surface 164*b* of the horizontal extension part 164.

The first lower protrusion 167 may be disposed at an opposite to the first upper protrusion 165 with respect to the horizontal extension part 164. The second lower protrusion 168 may be disposed at an opposite side of the second upper protrusion 166 with respect to the horizontal extension part 164.

The first lower protrusion 167 may be spaced apart from the vertical wall 153*a* of the upper tray body 151. The second lower protrusion 168 may be spaced apart from the curved wall 153*b* of the upper tray body 151.

Each of the plurality of lower protrusions 167 and 168 may also be provided in a curved shape. Since the protrusions 165, 166, 167, and 168 are disposed on each of the top and bottom surfaces 164*a* and 164*b* of the horizontal extension part 164, the deformation in the horizontal direction of the horizontal extension part 164 may be effectively prevented.

A through-hole 169 through which the coupling boss of the upper support 170, which will be described later, may be provided in the horizontal extension part 164.

For example, a plurality of through-holes 169 may be provided in the horizontal extension part 164.

A portion of the plurality of through-holes 169 may be disposed between the two first upper protrusions 165 adjacent to each other or the two first lower protrusions 167 adjacent to each other.

The other portion of the plurality of through-holes 169 may be disposed between the two second lower protrusions 168 adjacent to each other or be disposed to face a region between the two second lower protrusions 168.

Meanwhile, a bottom surface 151*a* of the upper tray body 151 may include a first surface 151*a*1 that is a bottom surface of the curved wall 153*b*, and a second surface 151*a*2 that is a bottom surface disposed on an opposite side of the curved wall 153*b* among the vertical wall 153*a*.

The first surface 151*a*1 and the second surface 151*a*2 may be formed to have different heights.

As an example, the bottom surface of the upper tray body 151 is inclined downward as the first surface 151*a*1 goes farther to the second surface 151*a*2.

As illustrated in FIG. 10, the first surface 151*a*1 may be higher than the second surface 151*a*2. Thus, a height difference (G) of a predetermined interval is present in a vertical direction between the first surface 151*a*1 and the second surface 151*a*2. In one implementation, G may be between 0.2 and 0.5 mm.

The first surface 151*a*1 may be a horizontal surface or an inclined surface inclined downward to face the first surface 151*a*1.

The second surface 151*a*2 may be a horizontal surface or an inclined surface inclined upward to face the first surface 151*a*1.

In this embodiment, the ground that the heights of the first surface 151*a*1 and the second surface 151*a*2 are made different among the bottom surface of the upper tray body 151 is to overall contact a bottom surface 151*a* of the upper tray body 151 with a top surface 251*a* of the lower tray body 251 in a process of contacting a top surface 251*a* of the lower tray body 251.

The process of overall contacting the bottom surface 151*a* of the upper tray body 151 with the top surface 251*a* of the lower tray body 251 will be described below.

<Upper Support>

Figure 12:
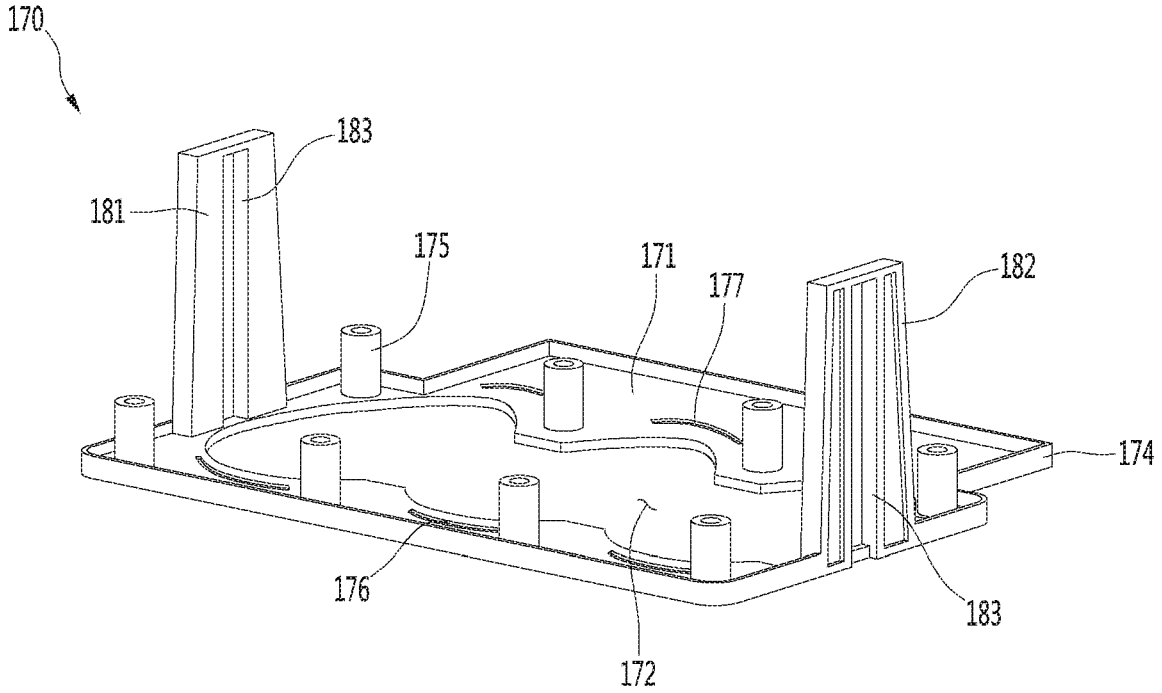
FIG. 12 is a top perspective view of the upper support according to one embodiment of the present invention.
Figure 13:
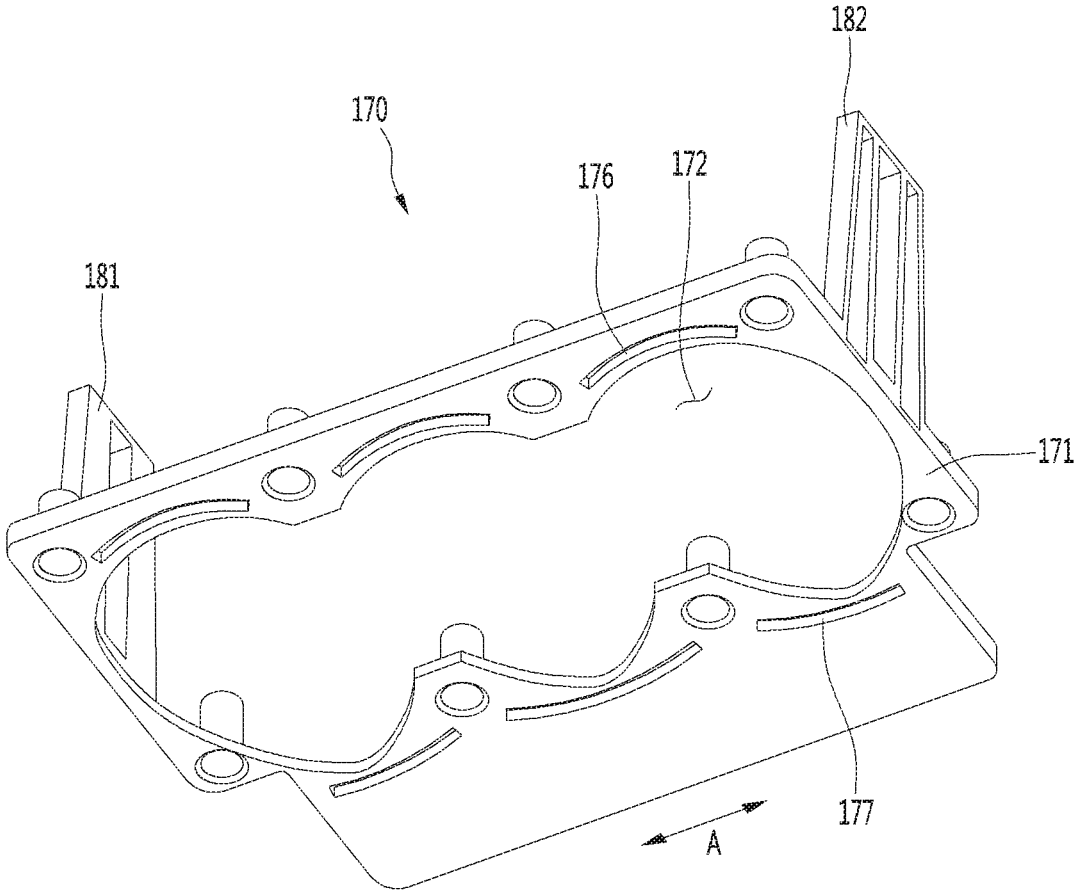
FIG. 13 is a bottom perspective view of the upper support according to one embodiment of the present invention.

FIG. 12 is a top perspective view of the upper support according to an embodiment, and FIG. 13 is a bottom perspective view of the upper support according to an embodiment.

Referring to FIGS. 12 and 13, the upper support 170 may include a support plate 171 contacting the upper tray 150.

For example, a top surface of the support plate 171 may contact the bottom surface 164*b* of the horizontal extension part 164 of the upper tray 150.

A plate opening 172 through which the upper tray body 151 passes may be defined in the support plate 171.

A circumferential wall 174 that is bent upward may be provided on an edge of the support plate 171. For example, the circumferential wall 174 may contact at least a portion of a circumference of a side surface of the horizontal extension part 164.

Also, a top surface of the circumferential wall 174 may contact a bottom surface of the upper plate 121.

The support plate 171 may include a plurality of lower slots 176 and 177.

The plurality of lower slots 176 and 177 may include a first lower slot 176 into which the first lower protrusion 167 is inserted and a second lower slot 177 into which the second lower protrusion 168 is inserted.

The plurality of first lower slots 176 may be disposed to be spaced apart from each other in the direction of the arrow A on the support plate 171. Also, the plurality of second lower slots 177 may be disposed to be spaced apart from each other in the direction of the arrow A on the support plate 171.

The support plate 171 may further include a plurality of coupling bosses 175. The plurality of coupling bosses 175 may protrude upward from the top surface of the support plate 171.

Each of the coupling bosses 175 may pass through the through-hole 169 of the horizontal extension part 164 and be inserted into the sleeve 133 of the upper case 120.

In the state in which the coupling boss 175 is inserted into the sleeve 133, a top surface of the coupling boss 175 may be disposed at the same height as a top surface of the sleeve 133 or disposed at a height lower than that of the top surface of the sleeve 133.

A coupling member coupled to the coupling boss 175 may be, for example, a bolt (see reference symbol B1 of FIG. 3). The bolt B1 may include a body part and a head part having a diameter greater than that of the body part. The bolt B1 may be coupled to the coupling boss 175 from an upper side of the coupling boss 175.

While the body part of the bolt B1 is coupled to the coupling boss 175, when the head part contacts the top surface of the sleeve 133, and the head part contacts the top surface of the sleeve 133 and the top surface of the coupling boss 175, assembling of the upper assembly 110 may be completed.

The upper support 170 may further include a plurality of unit guides 181 and 182 for guiding the connection unit 350 connected to the upper ejector 300.

The plurality of unit guides 181 and 182 may be, for example, disposed to be spaced apart from each other in the direction of the arrow A with respect to FIG. 12.

The unit guides 181 and 182 may extend upward from the top surface of the support plate 171. Each of the unit guides 181 and 182 may be connected to the circumferential wall 174.

Each of the unit guides 181 and 182 may include a guide slot 183 vertically extends.

In a state in which both ends of the ejector body 310 of the upper ejector 300 pass through the guide slot 183, the connection unit 350 is connected to the ejector body 310.

Thus, when the rotation force is transmitted to the ejector body 310 by the connection unit 350 while the lower assembly 200 rotates, the ejector body 310 may vertically move along the guide slot 183.

Figure 14:
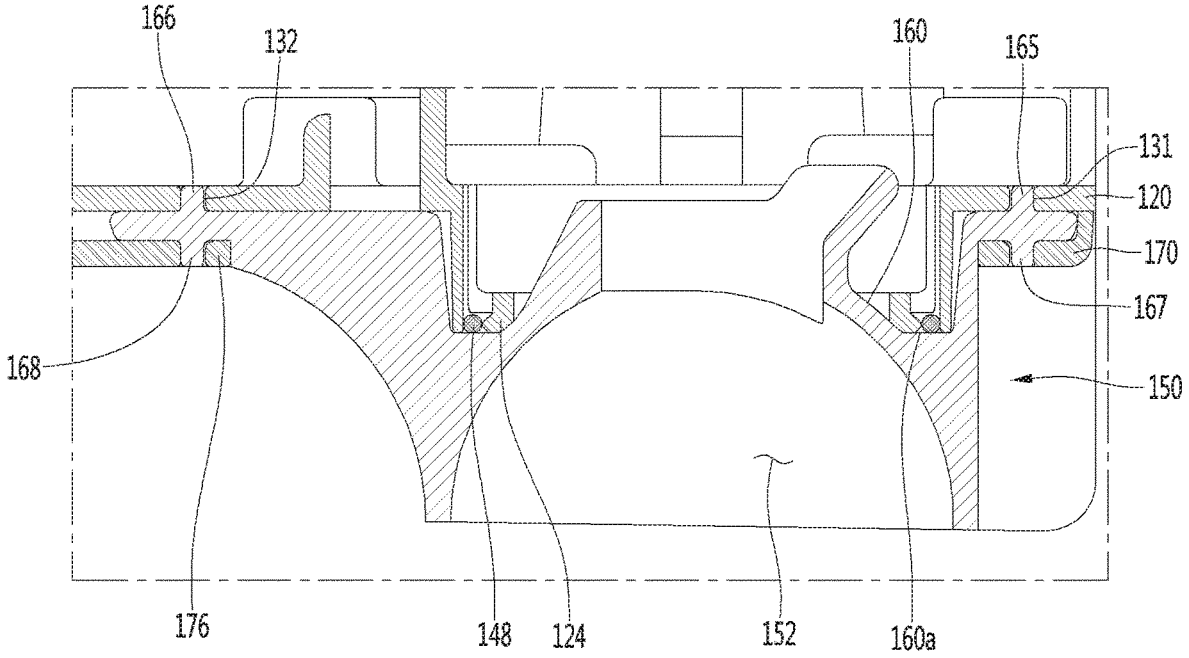
FIG. 14 is a cross-sectional view illustrating a state in which an upper assembly is assembled.

FIG. 14 is a cross-sectional view illustrating a state in which an upper assembly is assembled.

Referring to FIG. 14, in the state in which the upper heater 148 is coupled to the heater coupling part 124 of the upper case 120, the upper case 120, the upper tray 150, and the upper support 170 may be coupled to each other.

The first upper protrusion 165 of the upper tray 150 may be inserted into the first upper slot 131 of the upper case 120. Also, the second upper protrusion 166 of the upper tray 150 may be inserted into the second upper slot 132 of the upper case 120.

Then, the first lower protrusion 167 of the upper tray 150 may be inserted into the first lower slot 176 of the upper support 170, and the second lower protrusion 168 of the upper tray 150 may be inserted into the second lower slot 177 of the upper support 170.

Thus, the coupling boss 175 of the upper support 170 may pass through the through-hole of the upper tray 150 and then be accommodated in the sleeve 133 of the upper case 120. In this state, the bolt B1 may be coupled to the coupling boss 175 from an upper side of the coupling boss 175.

In the state in which the bolt B1 is coupled to the coupling boss 175, the head part of the bolt B1 may be disposed at a position higher than that of the upper plate 121.

On the other hand, since the hinge supports 135 and 136 are disposed lower than the upper plate 121, while the lower assembly 200 rotates, the upper assembly 110 or the connection unit 350 may be prevented from interfering with the head part of the bolt B1.

While the upper assembly 110 is assembled, a plurality of unit guides 181 and 182 of the upper support 170 may protrude upward from the upper plate 121 through the through-opening (see reference numerals 139*a* and 139*b* of FIG. 6) defined in both sides of the upper plate 121.

As described above, the upper ejector 300 passes through the guide slots 183 of the unit guides 181 and 182 protruding upward from the upper plate 121.

Thus, the upper ejector 300 may descend in the state of being disposed above the upper plate 121 and be inserted into the upper chamber 152 to separate ice of the upper chamber 152 from the upper tray 150.

When the upper assembly 110 is assembled, the heater coupling part 124 to which the upper heater 148 is coupled may be accommodated in the first accommodation part 160 of the upper tray 150.

In the state in which the heater coupling part 124 is accommodated in the first accommodation part 160, the upper heater 148 may contact the bottom surface 160*a* of the first accommodation part 160.

Like this embodiment, when the upper heater 148 is accommodated in the heater coupling part 124 having the recessed shape to contact the upper tray body 151, heat of the upper heater 148 may be minimally transferred to another portion except for the upper tray body 151.

At least a portion of the upper heater 148 may be disposed to vertically overlap the upper chamber 152 so that the heat of the upper heater 148 is smoothly transferred to the upper chamber 152.

In this embodiment, the upper rounded portion 148*c* of the upper heater 148 may vertically overlap the upper chamber 152.

That is, a maximum distance between two points of the upper rounded portion 148*c*, which are disposed at opposite sides with respect to the upper chamber 152 may be less than a diameter of the upper chamber 152.

Meanwhile, the upper heater 148 may be a DC heater that receives a DC power. The upper heater 148 may be on for ice separation.

When heat of the upper heater 148 is delivered to the upper tray 150, ice may be separated from a surface (an inner surface) of the upper tray 150.

If the upper tray 150 is formed of a metal material and the heat of the upper heater 148 gets stronger and stronger, after the upper heater 148 is off, a portion where part of ice is heated by the upper heater 148 is attached again to the surface of the upper tray 150, thereby creating an opaque phenomenon.

That is, an opaque strip of a shape corresponding to the upper heater around the ice is formed.

However, in the case of this embodiment, as the DC heater of which an output is low is used and the upper tray 150 is formed of a silicone material, an amount of the heat delivered to the upper tray 150 is reduced, and heat conductivity of the upper tray 150 itself is lowered.

Thus, since heat is not concentrated on a local part of the ice and a small amount of heat is gradually applied to the ice, the ice is effectively separated from the upper tray, and simultaneously the opaque strip is prevented from being formed around the ice.

<Lower Case>

Figure 15:
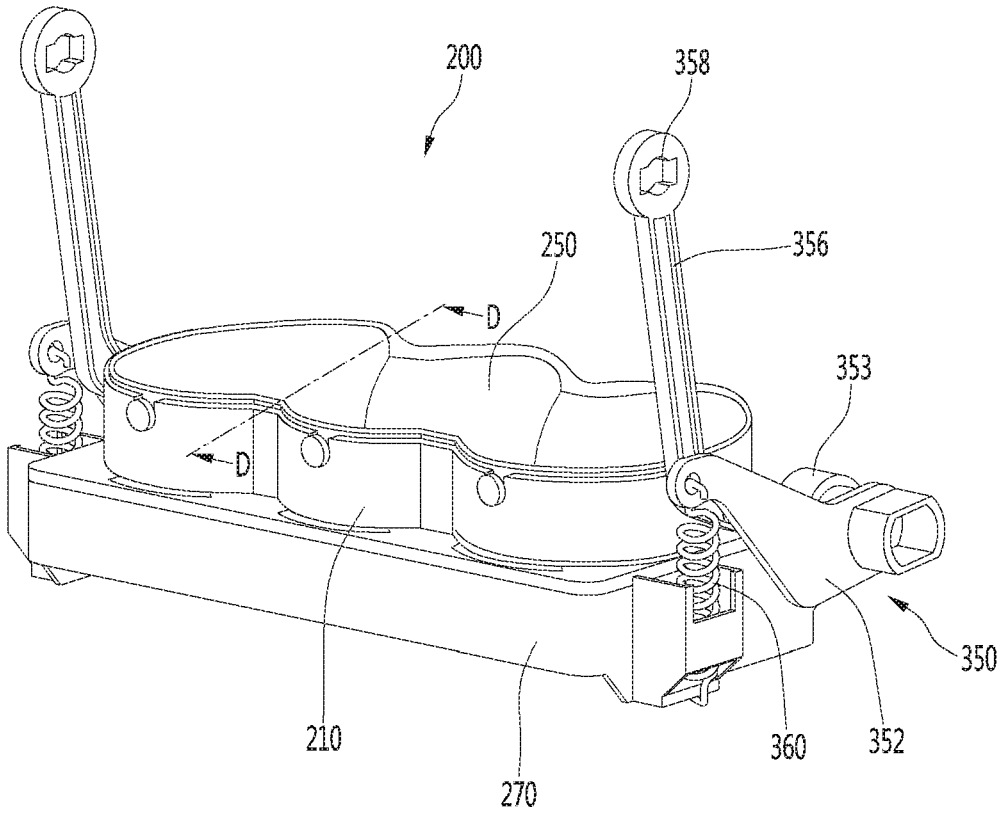
FIG. 15 is a perspective view of a lower assembly according to one embodiment of the present invention.
Figure 16:
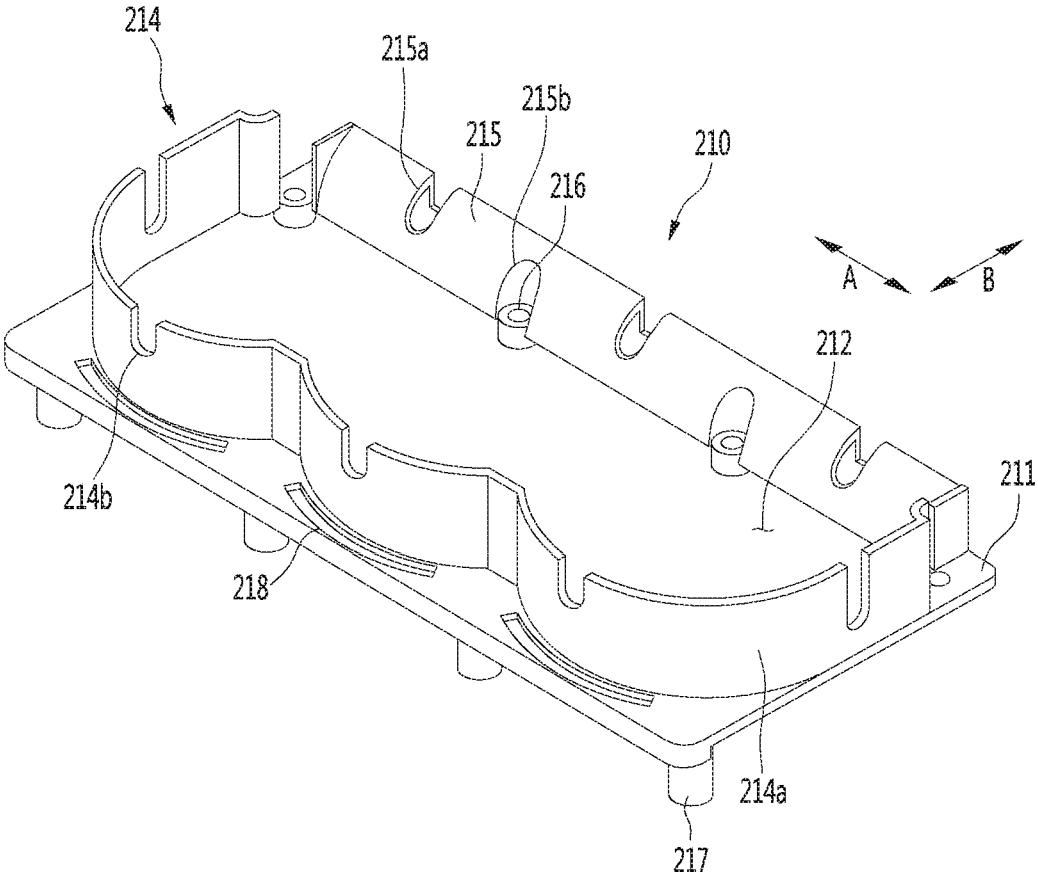
FIG. 16 is a top perspective view of a lower case according to one embodiment of the present invention.
Figure 17:
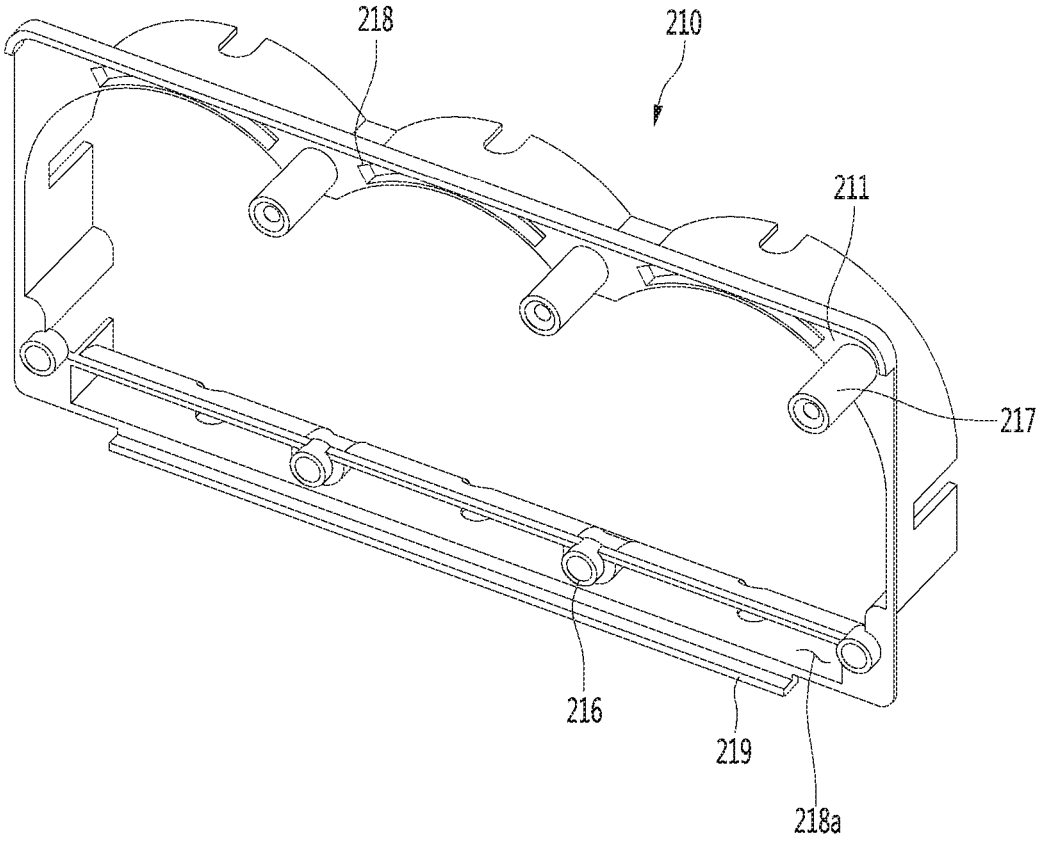
FIG. 17 is a bottom perspective view of the lower case according to one embodiment of the present invention.

FIG. 15 is a perspective view of a lower assembly according to an embodiment, FIG. 16 is a top perspective view of a lower case according to an embodiment, and FIG. 17 is a bottom perspective view of the lower case according to an embodiment.

Referring to FIGS. 15 to 17, the lower assembly 200 may include a lower tray 250. The lower tray 250 defines the ice chamber 121 together with the upper tray 150.

The lower assembly 200 may further include a lower support 270 that supports the lower tray 250. The lower support 270 and the lower tray 250 may rotate together while the lower tray 250 is seated on the lower support 270.

The lower assembly 200 may further include a lower case 210 for fixing a position of the lower tray 250.

The lower case 210 may surround the circumference of the lower tray 250, and the lower support 270 may support the lower tray 250.

The connection unit 350 may be coupled to the lower support 270.

The connection unit 350 may include a first link 352 that receives power of the driving unit 180 to allow the lower support 270 to rotate and a second link 356 connected to the lower support 270 to transmit rotation force of the lower support 270 to the upper ejector 300 when the lower support 270 rotates.

The first link 352 and the lower support 270 may be connected to each other by an elastic member 360. For example, the elastic member 360 may be a coil spring.

The elastic member 360 may have one end connected to the first link 362 and the other end connected to the lower support 270.

The elastic member 360 provide elastic force to the lower support 270 so that contact between the upper tray 150 and the lower tray 250 is maintained.

In this embodiment, the first link 352 and the second link 356 may be disposed on both sides of the lower support 270, respectively.

One of the two first links may be connected to the driving unit 180 to receive the rotation force from the driving unit 180.

The two first links 352 may be connected to each other by a connection shaft (see reference numeral 370 of FIG. 6).

A hole 358 through which the ejector body 310 of the upper ejector 300 passes may be defined in an upper end of the second link 356.

The lower case 210 may include a lower plate 211 for fixing the lower tray 250.

A portion of the lower tray 250 may be fixed to contact a bottom surface of the lower plate 211.

An opening 212 through which a portion of the lower tray 250 passes may be defined in the lower plate 211.

For example, when the lower tray 250 is fixed to the lower plate 211 in a state in which the lower tray 250 is disposed below the lower plate 211, a portion of the lower tray 250 may protrude upward from the lower plate 211 through the opening 212.

The lower case 210 may further include a circumferential wall 214 (or a cover wall) surrounding the lower tray 250 passing through the lower plate 211.

The circumferential wall 214 may include a vertical wall 214*a* and a curved wall 215.

The vertical wall 214*a* is a wall vertically extending upward from the lower plate 211. The curved wall 215 is a wall that is rounded in a direction that is away from the opening 212 upward from the lower plate 211.

The vertical wall 214*a* may include a first coupling slit 214*b* coupled to the lower tray 250. The first coupling slit 214*b* may be defined by recessing an upper end of the vertical wall downward.

The curved wall 215 may include a second coupling slit 215*a* to the lower tray 250.

The second coupling slit 215*a* may be defined by recessing an upper end of the curved wall 215 downward.

The lower case 210 may further include a first coupling boss 216 and a second coupling boss 217.

The first coupling boss 216 may protrude downward from the bottom surface of the lower plate 211. For example, the plurality of first coupling bosses 216 may protrude downward from the lower plate 211.

The plurality of first coupling bosses 216 may be arranged to be spaced apart from each other in the direction of the arrow A with respect to FIG. 16.

The second coupling boss 217 may protrude downward from the bottom surface of the lower plate 211. For example, the plurality of second coupling bosses 217 may protrude from the lower plate 211. The plurality of first coupling bosses 217 may be arranged to be spaced apart from each other in the direction of the arrow A with respect to FIG. 16.

The first coupling boss 216 and the second coupling boss 217 may be disposed to be spaced apart from each other in the direction of the arrow B.

In this embodiment, a length of the first coupling boss 216 and a length of the second coupling boss 217 may be different from each other. For example, the first coupling boss 216 may have a length less than that of the second coupling boss 217.

The first coupling member may be coupled to the first coupling boss 216 at an upper portion of the first coupling boss 216. On the other hand, the second coupling member may be coupled to the second coupling boss 217 at a lower portion of the second coupling boss 217.

A groove 215*b* for movement of the coupling member may be defined in the curved wall 215 to prevent the first coupling member from interfering with the curved wall 215 while the first coupling member is coupled to the first coupling boss 216.

The lower case 210 may further include a slot 218 coupled to the lower tray 250.

A portion of the lower tray 250 may be inserted into the slot 218. The slot 218 may be disposed adjacent to the vertical wall 214*a*.

For example, a plurality of slots 218 may be defined to be spaced apart from each other in the direction of the arrow A of FIG. 16. Each of the slots 218 may have a curved shape.

The lower case 210 may further include an accommodation groove 218*a* into which a portion of the lower tray 250 is inserted.

The accommodation groove 218*a* may be defined by recessing a portion of the lower tray 211 toward the curved wall 215.

The lower case 210 may further include an extension wall 219 contacting a portion of the circumference of the side surface of the lower plate 212 in the state of being coupled to the lower tray 250. The extension wall 219 may linearly extend in the direction of the arrow A.

<Lower Tray>

Figure 18:
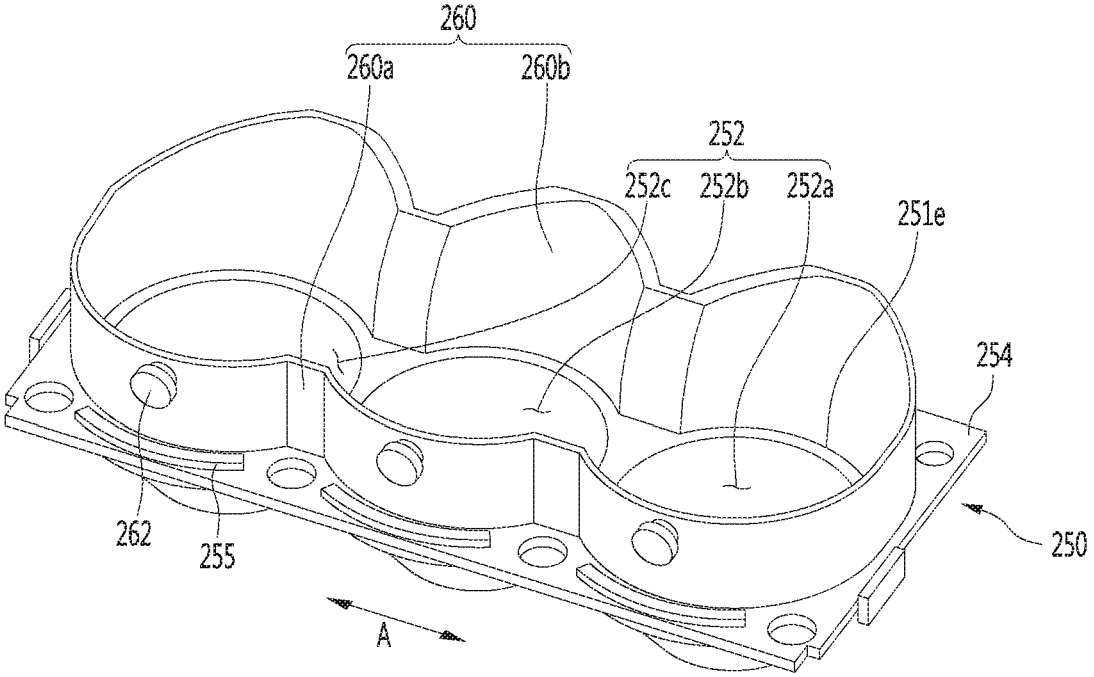
FIG. 18 is a top perspective view of the lower tray according to one embodiment of the present invention.
Figure 19:
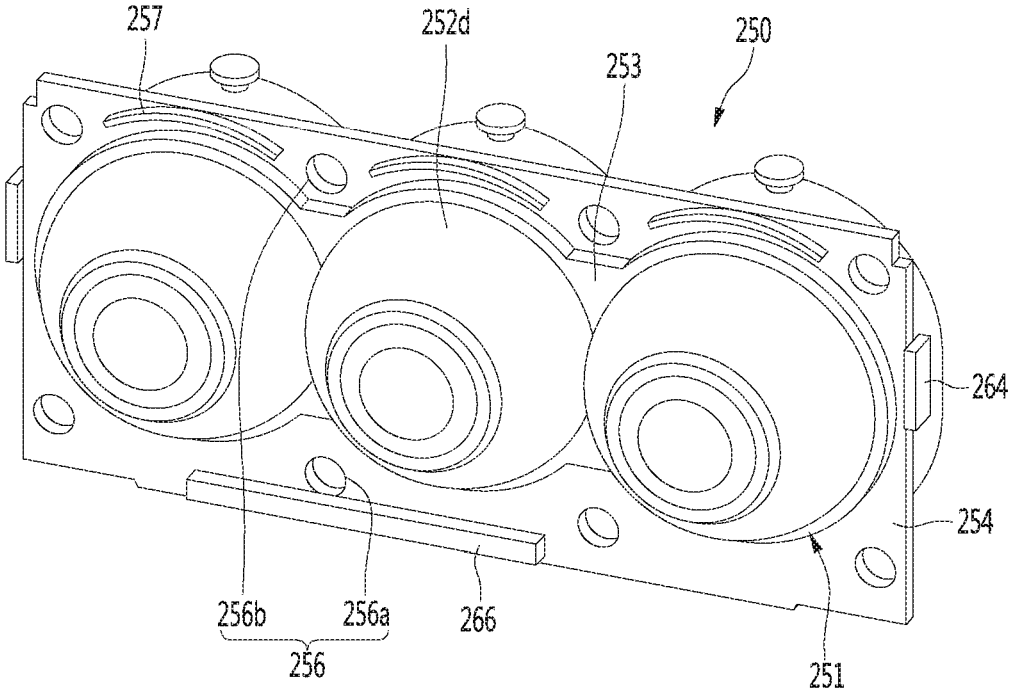
FIGS. 19 and 20 are bottom perspective views of the lower tray according to one embodiment of the present invention.
Figure 20:
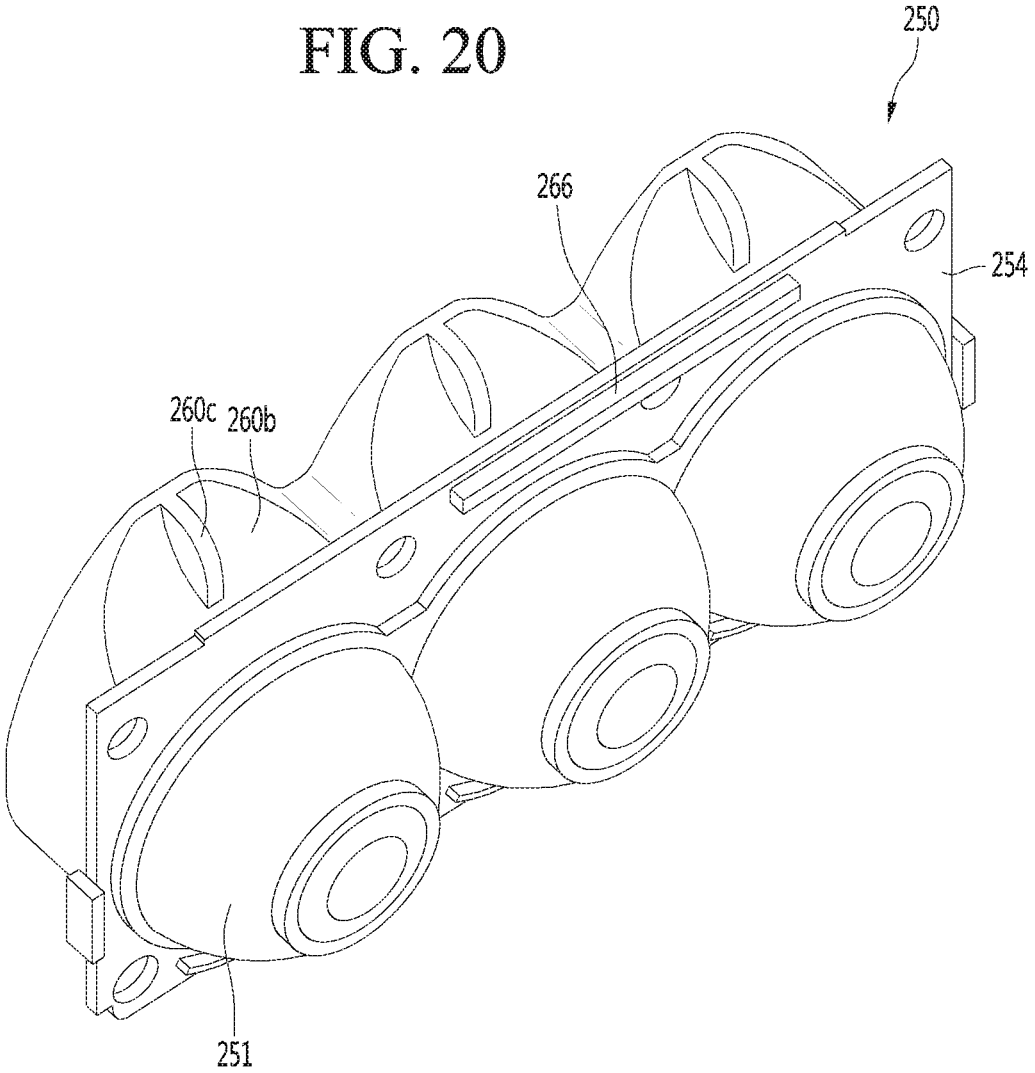
Figure 21:
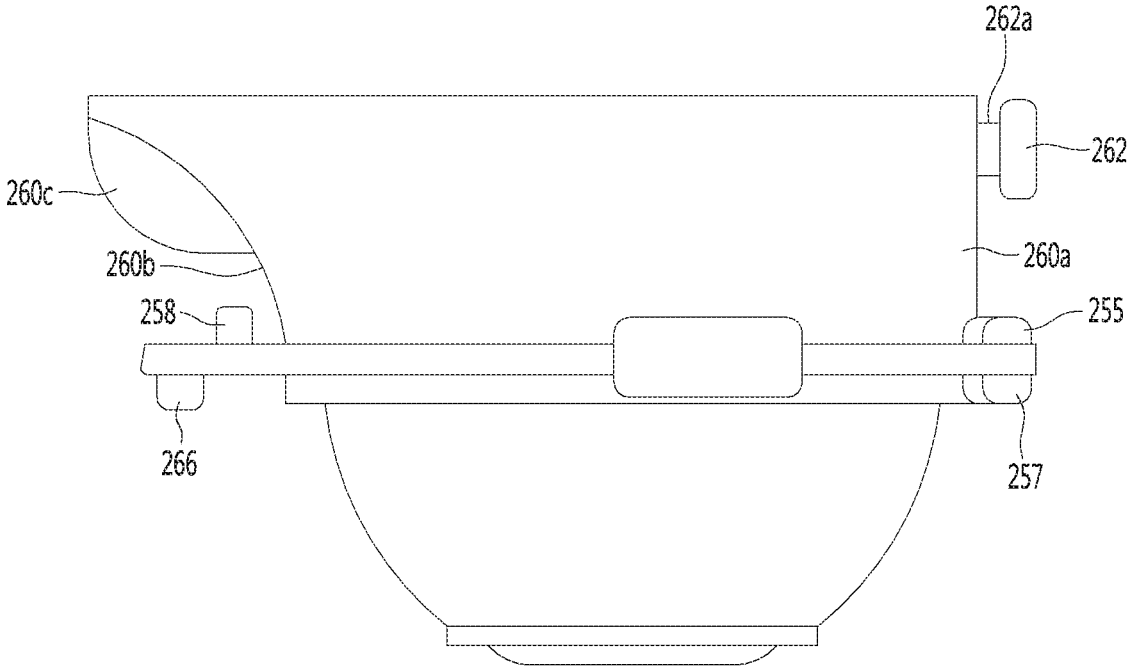
FIG. 21 is a side view of the lower tray according to one embodiment of the present invention.

FIG. 18 is a top perspective view of the lower tray according to an embodiment, FIGS. 19 and 20 are bottom perspective views of the lower tray according to an embodiment, and FIG. 21 is a side view of the lower tray according to an embodiment.

Referring to FIGS. 18 to 21, the lower tray 250 may be made of a flexible material that is capable of being restored to its original shape after being deformed by an external force.

For example, the lower tray 250 may be made of a silicone material. Like this embodiment, when the lower tray 250 is made of a silicone material, the lower tray 250 may be restored to its original shape even through external force is applied to deform the lower tray 250 during the ice separating process. Thus, in spite of repetitive ice making, spherical ice may be made.

If the lower tray 250 is made of a metal material, when the external force is applied to the lower tray 250 to deform the lower tray 250 itself, the lower tray 250 may not be restored to its original shape any more.

In this case, after the lower tray 250 is deformed in shape, the spherical ice may not be made. That is, it is impossible to repeatedly make the spherical ice.

On the other hand, like this embodiment, when the lower tray 250 is made of the flexible material that is capable of being restored to its original shape, this limitation may be solved.

Also, when the lower tray 250 is made of the silicone material, the lower tray 250 may be prevented from being melted or thermally deformed by heat provided from an upper heater that will be described later.

The lower tray 250 may include a lower tray body 251 defining a lower chamber 252 that is a portion of the ice chamber 111.

The lower tray body 251 may be define a plurality of lower chambers 252.

For example, the plurality of lower chambers 252 may include a first lower chamber 252*a*, a second lower chamber 252*b*, and a third lower chamber 252*c*.

The lower tray body 251 may include three chamber walls 252*d* defining three independent lower chambers 252*a*, 252*b*, and 252*c*. The three chamber walls 252*d* may be integrated in one body to form the lower tray body 251.

The first lower chamber 252*a*, the second lower chamber 252*b*, and the third lower chamber 252*c* may be arranged in a line. For example, the first lower chamber 252*a*, the second lower chamber 252*b*, and the third lower chamber 252*c* may be arranged in a direction of an arrow A with respect to FIG. 20.

Accordingly, the lower chamber 252 may have a hemispherical shape or a shape similar to the hemispherical shape. That is, a lower portion of the spherical ice may be made by the lower chamber 252.

The lower tray 250 may further include a first extension part 253 horizontally extending from an edge of an upper end of the lower tray body 251. The first extension part 253 may be continuously formed along the circumference of the lower tray body 251.

The lower tray 250 may further include a circumferential wall 260 extended upward from an upper surface of the first extension part 253.

A bottom surface of the upper tray body 151 may be in contact with the top surface 251*e* of the lower tray body 251.

The circumferential wall 260 may surround the upper tray body 251 seated on the top surface 251*e* of the lower tray body 251.

The circumferential wall 260 may include a first wall 260*a* surrounding the vertical wall 153*a* of the upper tray body 151 and a second wall 260*b* surrounding the curved wall 153*b* of the upper tray body 151.

The first wall 260*a* is a vertical wall vertically extending from the top surface of the first extension part 253. The second wall 260*b* is a curved wall having a shape corresponding to that of the upper tray body 151. That is, the second wall 260*b* may be rounded upward from the first extension part 253 in a direction that is away from the lower chamber 252.

The lower tray 250 may further include a second extension part 254 horizontally extending from the circumferential wall 260.

The second extension part 254 may be disposed higher than the first extension part 253. Thus, the first extension part 253 and the second extension part 254 may be stepped with respect to each other.

The second extension part 254 may include a first upper protrusion 255 inserted into the slot 218 of the lower case 210. The first upper protrusion 255 may be disposed to be horizontally spaced apart from the circumferential wall 260.

For example, the first upper protrusion 255 may protrude upward from a top surface of the second extension part 254 at a position adjacent to the first wall 260*a*.

Although not limited, a plurality of first upper protrusions 255 may be arranged to be spaced apart from each other in the direction of the arrow A with respect to FIG. 20. The first upper protrusion 255 may extend, for example, in a curved shape.

The second extension part 254 may include a first lower protrusion 257 inserted into a protrusion groove of the lower case 270, which will be described later. The first lower protrusion 257 may protrude downward from a bottom surface of the second extension part 254.

Although not limited, the plurality of first lower protrusions 257 may be arranged to be spaced apart from each other in the direction of arrow A.

The first upper protrusion 255 and the first lower protrusion 257 may be disposed at opposite sides with respect to a vertical direction of the second extension part 254. At least a portion of the first upper protrusion 255 may vertically overlap the second lower protrusion 257.

A plurality of through-holes may be defined in the second extension part 254.

The plurality of through-holes 256 may include a first through-hole 256*a* through which the first coupling boss 216 of the lower case 210 passes and a second through-hole 256*b* through which the second coupling boss 217 of the lower case 210 passes.

For example, the plurality of through-holes 256*a* may be defined to be spaced apart from each other in the direction of the arrow A of FIG. 18.

Also, the plurality of second through-holes 256*b* may be disposed to be spaced apart from each other in the direction of the arrow A of FIG. 18.

The plurality of first through-holes 256*a* and the plurality of second through-holes 256*b* may be disposed at opposite sides with respect to the lower chamber 252.

A portion of the plurality of second through-holes 256*b* may be defined between the two first upper protrusions 255. Also, a portion of the plurality of second through-holes 256*b* may be defined between the two first lower protrusions 257.

The second extension part 254 may further a second upper protrusion 258. The second upper protrusion 258 may be disposed at an opposite side of the first upper protrusion 255 with respect to the lower chamber 252.

The second upper protrusion 258 may be disposed to be horizontally spaced apart from the circumferential wall 260. For example, the second upper protrusion 258 may protrude upward from a top surface of the second extension part 254 at a position adjacent to the second wall 260*b*.

Although not limited, the plurality of second upper protrusions 258 may be arranged to be spaced apart from each other in the direction of the arrow A of FIG. 20.

The second upper protrusion 258 may be accommodated in the accommodation groove 218*a* of the lower case 210. In the state in which the second upper protrusion 258 is accommodated in the accommodation groove 218*a*, the second upper protrusion 258 may contact the curved wall 215 of the lower case 210.

The circumferential wall 260 of the lower tray 250 may include a first coupling protrusion 262 coupled to the lower case 210.

The first coupling protrusion 262 may horizontally protrude from the first wall 260*a* of the circumferential wall 260. The first coupling protrusion 262 may be disposed on an upper portion of a side surface of the first wall 260*a*.

The first coupling protrusion 262 may include a neck part 262*a* having a relatively less diameter when compared to those of other portions. The neck part 262*a* may be inserted into a first coupling slit 214*b* defined in the circumferential wall 214 of the lower case 210.

The circumferential wall 260 of the lower tray 250 may further include a second coupling protrusion 262*c* coupled to the lower case 210.

The second coupling protrusion 262*c* may horizontally protrude from the second wall 260*a* of the circumferential wall 260. The second coupling protrusion 260*c* may be inserted into a second coupling slit 215*a* defined in the circumferential wall 214 of the lower case 210.

The second extension part 254 may include a second lower protrusion 266. The second lower protrusion 266 may be disposed at an opposite side of the second lower protrusion 257 with respect to the lower chamber 252.

The second lower protrusion 266 may protrude downward from a bottom surface of the second extension part 254. For example, the second lower protrusion 266 may linearly extend.

A portion of the plurality of first through-holes 256*a* may be defined between the second lower protrusion 266 and the lower chamber 252.

The second lower protrusion 266 may be accommodated in a guide groove defined in the lower support 270, which will be described later.

The second extension part 254 may further a side restriction part 264. The side restriction part 264 restricts horizontal movement of the lower tray 250 in the state in which the lower tray 250 is coupled to the lower case 210 and the lower support 270.

The side restriction part 264 laterally protrudes from the second extension part 254 and has a vertical length greater than a thickness of the second extension part 254. For example, one portion of the side restriction part 264 may be disposed higher than the top surface of the second extension part 254, and the other portion of the side restriction part 264 may be disposed lower than the bottom surface of the second extension part 254.

Thus, the one portion of the side restriction part 264 may contact a side surface of the lower case 210, and the other portion may contact a side surface of the lower support 270. In one example, the lower tray body 251 may has a heater contact portion 251*a* which the lower heater 296 contacts. In one example, the heater contact portion 251*a* may be formed on each of the chamber walls 252*d*. The heater contact portion 251*a* may protrude from the respective chamber wall 252*d*. In one example, the heater contact portion 251*a* may be formed in a circular ring shape.

<Lower Support>

Figure 22:
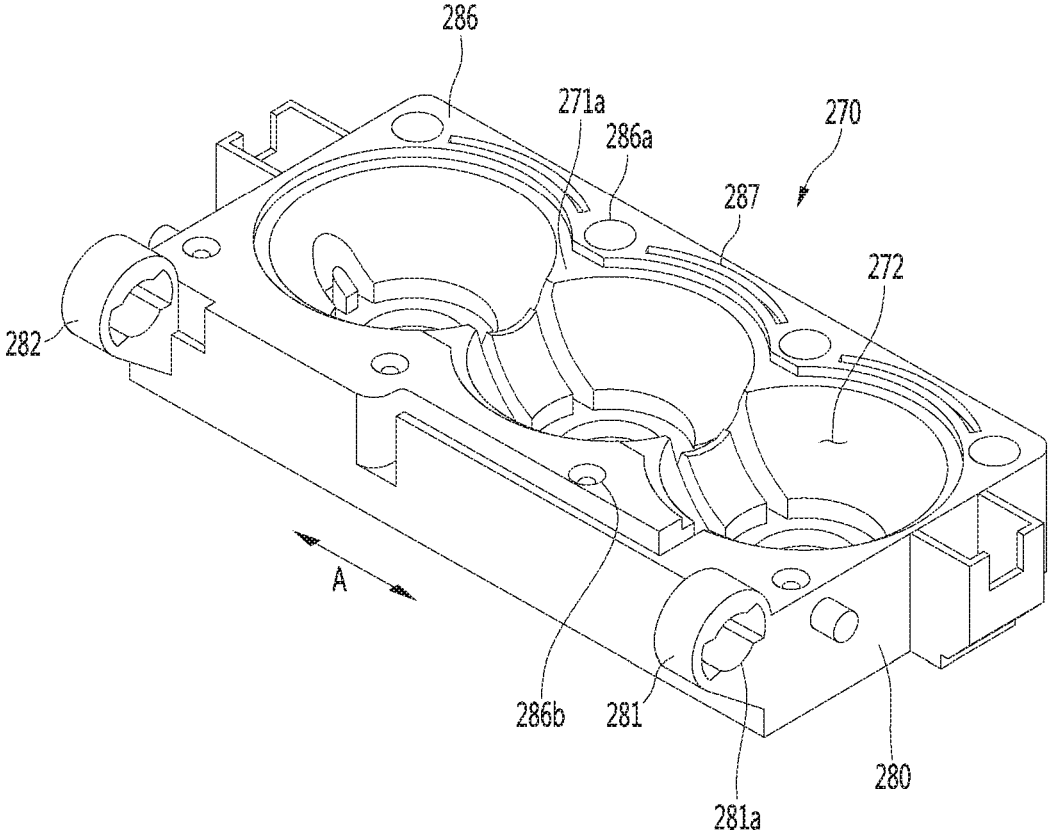
FIG. 22 is a top perspective view of the lower support according to one embodiment of the present invention.
Figure 23:
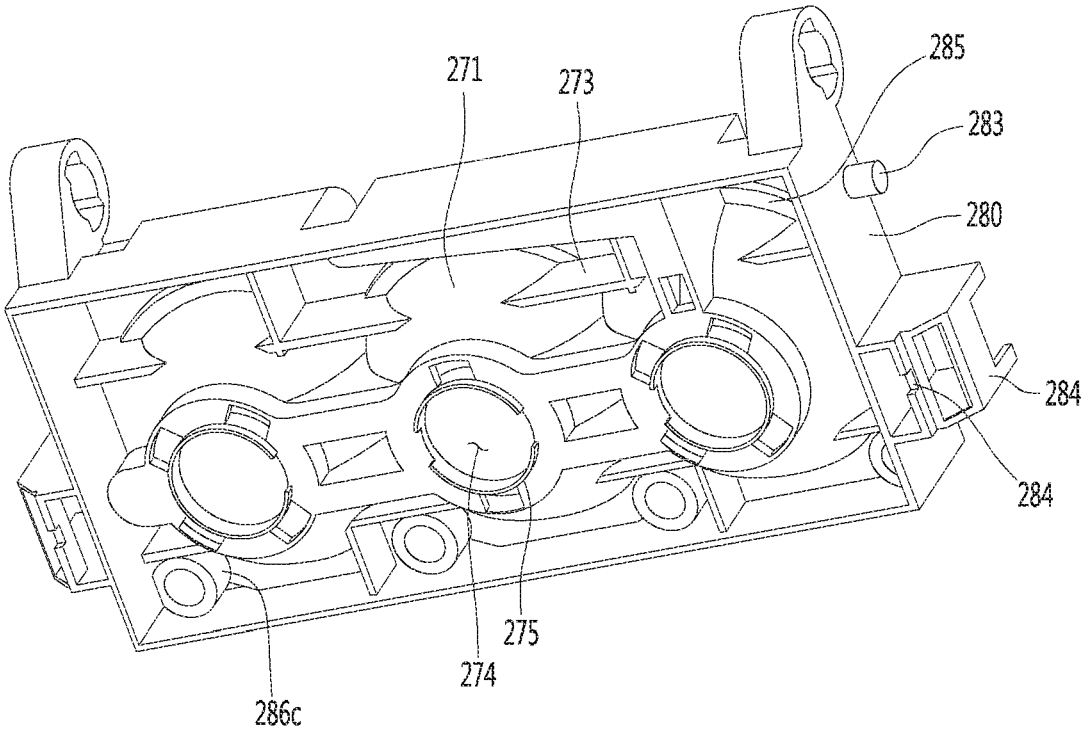
FIG. 23 is a bottom perspective view of the lower support according to one embodiment of the present invention.
Figure 24:
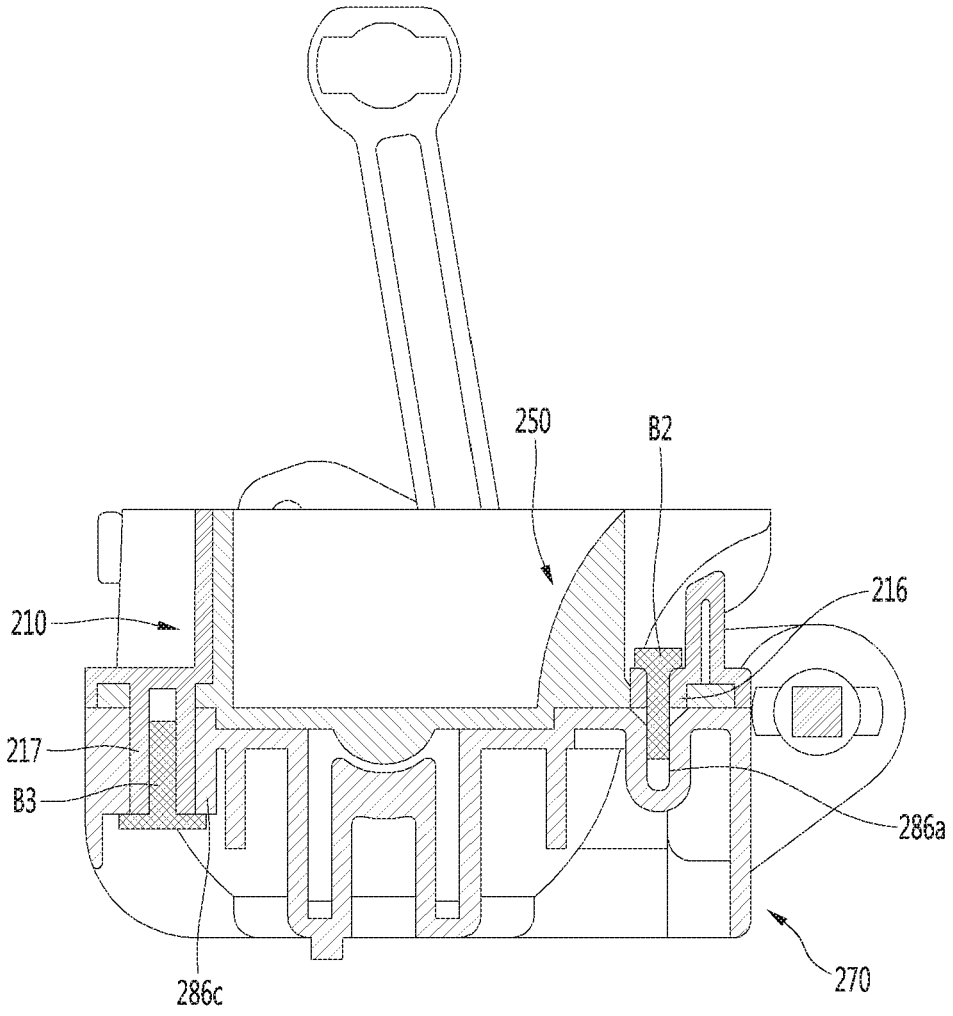
FIG. 24 is a cross-sectional view taken along line D-D of FIG. 16 for illustrating a state in which a lower assembly is assembled.

FIG. 22 is a top perspective view of the lower support according to an embodiment, FIG. 23 is a bottom perspective view of the lower support according to an embodiment, and FIG. 24 is a cross-sectional view taken along line D-D of FIG. 16 for illustrating a state in which a lower assembly is assembled.

Referring to FIGS. 22 to 24, the lower support 270 may include a support body 271 supporting the lower tray 250.

The support body 271 may include three chamber accommodation parts 272 accommodating the three chamber walls 252*d* of the lower tray 250. The chamber accommodation part 272 may have a hemispherical shape.

The support body 271 may have a lower opening 274 through which the lower ejector 400 passes during the ice separating process. For example, three lower openings 274 may be defined to correspond to the three chamber accommodation parts 272 in the support body 271.

A reinforcement rib 275 reinforcing strength may be disposed along a circumference of the lower opening 274.

The adjacent two accommodation part 272 of the three accommodation parts 272 may be connected to each other by a connection rib 273. The connection rib 273 may reinforce strength of the chamber wells 252*d*.

The lower support 270 may further include a first extension wall 285 horizontally extending from an upper end of the support body 271.

The lower support 270 may further include a second extension wall 286 that is formed to be stepped with respect to the first extension wall 285 on an edge of the first extension wall 285.

A top surface of the second extension wall 286 may be disposed higher than the first extension wall 285.

The first extension part 253 of the lower tray 250 may be seated on a top surface 271*a* of the support body 271, and the second extension part 285 may surround side surface of the first extension part 253 of the lower tray 250. Here, the second extension wall 286 may contact the side surface of the first extension part 253 of the lower tray 250.

The lower support 270 may further include a protrusion groove 287 accommodating the first lower protrusion 257 of the lower tray 250.

The protrusion groove 287 may extend in a curved shape. The protrusion groove 287 may be defined, for example, in a second extension wall 286.

The lower support 270 may further include a first coupling groove 286*a* to which a first coupling member B2 passing through the first coupling boss 216 of the upper case 210 is coupled.

The first coupling groove 286*a* may be provided, for example, in the second extension wall 286.

The plurality of first coupling grooves 286*a* may be disposed to be spaced apart from each other in the direction of the arrow A in the second extension wall 286. A portion of the plurality of first coupling grooves 286*a* may be defined between the adjacent two protrusion grooves 287.

The lower support 270 may further include a boss through-hole 286*b* through which the second coupling boss 217 of the upper case 210 passes.

The boss through-hole 286*b* may be provided, for example, in the second extension wall 286. A sleeve 286*c* surrounding the second coupling boss 217 passing through the boss through-hole 286*b* may be disposed on the second extension wall 286. The sleeve 286*c* may have a cylindrical shape with an opened lower portion.

The first coupling member B2 may be coupled to the first coupling groove 286*a* after passing through the first coupling boss 216 from an upper side of the lower case 210.

The second coupling member B3 may be coupled to the second coupling boss 217 from a lower side of the lower support 270.

The sleeve 286*c* may have a lower end that is disposed at the same height as a lower end of the second coupling boss 217 or disposed at a height lower than that of the lower end of the second coupling boss 217.

Thus, while the second coupling member B3 is coupled, the head part of the second coupling member B3 may contact bottom surfaces of the second coupling boss 217 and the sleeve 286*c* or may contact a bottom surface of the sleeve 286*c*.

The lower support 270 may further include an outer wall 280 disposed to surround the lower tray body 251 in a state of being spaced outward from the outside of the lower tray body 251.

The outer wall 280 may, for example, extend downward along an edge of the second extension wall 286.

The lower support 270 may further include a plurality of hinge bodies 281 and 282 respectively connected to hinge supports 135 and 136 of the upper case 210.

The plurality of hinge bodies 281 and 282 may be disposed to be spaced apart from each other in a direction of an arrow A of FIG. 22. Each of the hinge bodies 281 and 282 may further include a second hinge hole 281*a*.

The shaft connection part 353 of the first link 352 may pass through the second hinge hole 281. The connection shaft 370 may be connected to the shaft connection part 353.

A distance between the plurality of hinge bodies 281 and 282 may be less than that between the plurality of hinge supports 135 and 136. Thus, the plurality of hinge bodies 281 and 282 may be disposed between the plurality of hinge supports 135 and 136.

The lower support 270 may further include a coupling shaft 283 to which the second link 356 is rotatably coupled. The coupling shaft 383 may be disposed on each of both surfaces of the outer wall 280.

Also, the lower support 270 may further include an elastic member coupling part 284 to which the elastic member 360 is coupled. The elastic member coupling part 284 may define a space in which a portion of the elastic member 360 is accommodated. Since the elastic member 360 is accommodated in the elastic member coupling part 284 to prevent the elastic member 360 from interfering with the surrounding structure.

Also, the elastic member coupling part 284 may include a hook part 284*a* on which a lower end of the elastic member 370 is hooked.

Figure 25:
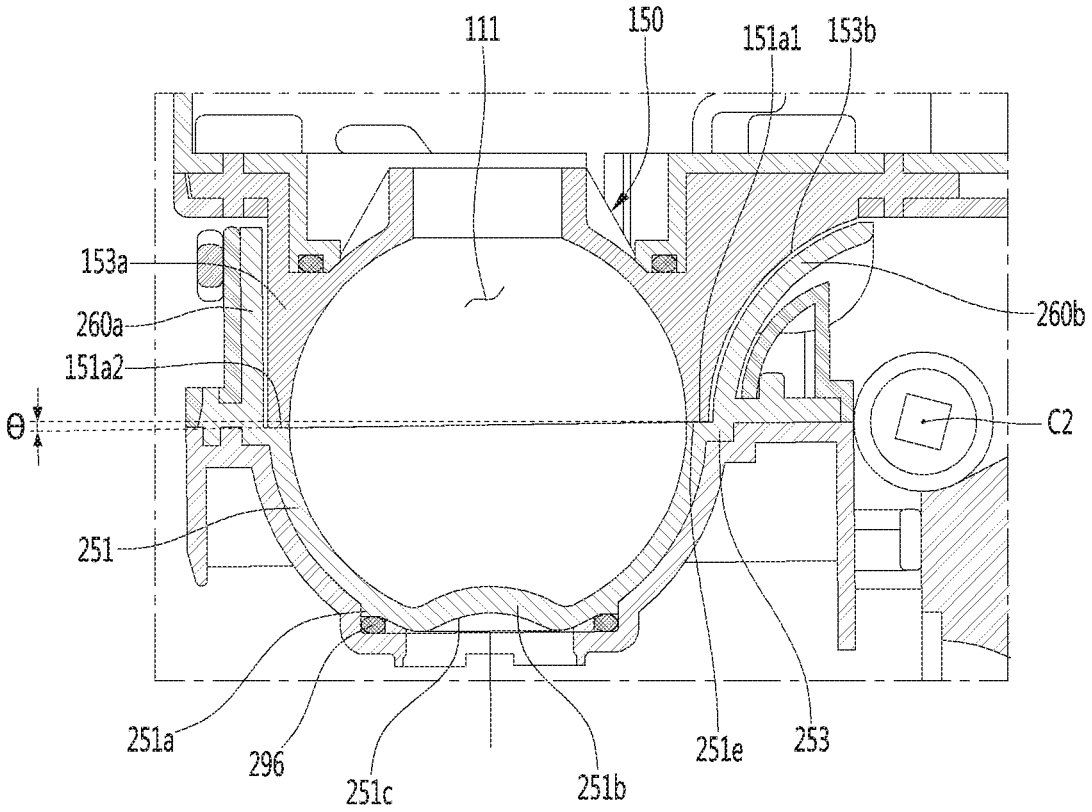
FIG. 25 is a cross-sectional view taken along line A-A of FIG. 3 at a time of contacting the lower tray and the upper tray.
Figure 26:
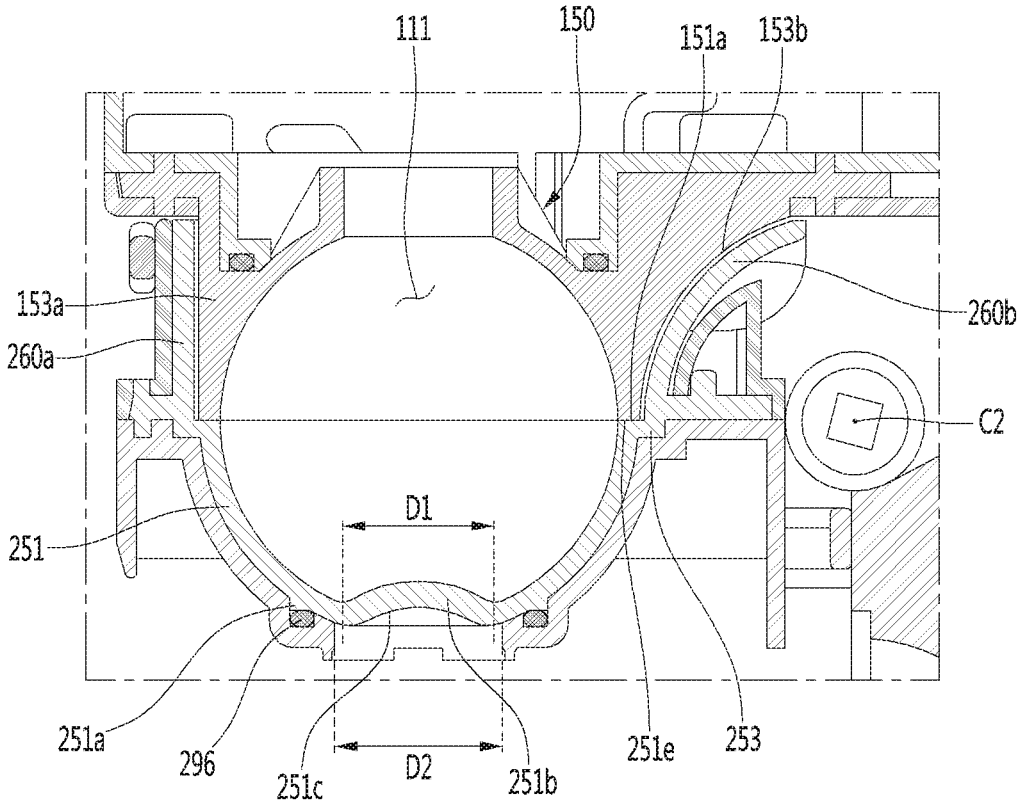
FIG. 26 is a cross-sectional view taken along line A-A of FIG. 3 in a state that a top surface of the lower tray closely contacts a bottom surface of the upper tray.
Figure 27:
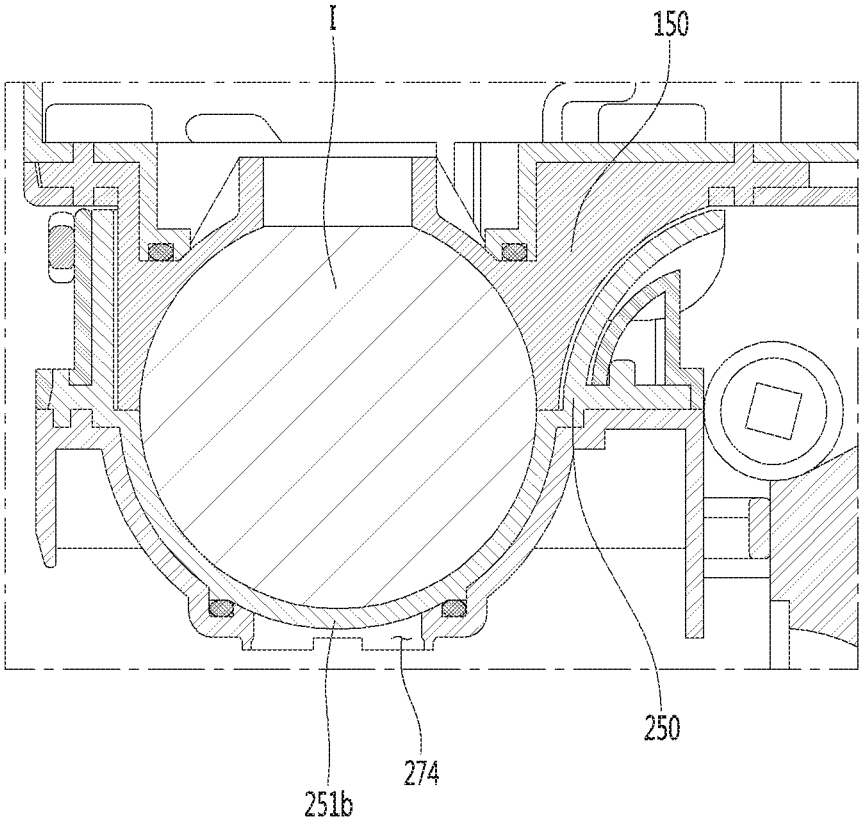
FIG. 27 is a view illustrating a state that generation of ice has been completed in FIG. 26.

FIG. 25 is a cross-sectional view taken along line A-A of FIG. 3, and FIG. 26 is a view illustrating a state in which ice is completely made in FIG. 25.

In FIG. 25, a state in which the upper tray and the lower tray contact each other is illustrated.

Referring to FIG. 25, the upper tray 150 and the lower tray 250 vertically contact each other to complete the ice chamber 111.

The lower assembly 200 may be rotated based on a rotational center (C2). The rotational center (C2) is a center of the connection shaft 370.

In this embodiment, a direction (a counterclockwise direction on the basis of the figure) that the lower assembly 200 is rotated for ice separation is named a forward direction, and an opposite direction (a clockwise direction) is named a reverse direction.

After the lower assembly 200 rotate in the forward direction for ice separation, the lower assembly 200 may rotate in the reverse direction for further ice making.

The lower assembly 200 may be rotated until a top surface 251*e* of the lower tray 250 is horizontalized by the driving unit 180 and the elastic member 360.

In this embodiment, in a state that the top surface 251*e* of the lower tray body 251 contacts the bottom surface 151*a* of the upper tray body 151, when the top surface 251*e* and the bottom surface 151*a* are pressed to each other, the gap between the top surface 251*e* of the lower tray body 251 and the bottom 151*a* of the upper tray body 151 disappears.

As such, the whole of the top surface 251*e* of the lower tray body 251 has to contact the whole of the bottom surface 151*a* of the upper tray body 151 such that the gap between the top surface 251*e* of the lower tray body 251 and the bottom 151*a* of the upper tray body 151 disappears.

In this embodiment, the top surface 251*e* of the lower tray body 251 is configured to contact the bottom 151*a* of the upper tray body 151 before the top surface 251*e* of the lower tray body 251 rotates to be horizontalized.

When the lower tray 250 is additionally rotated in the reverse direction in this state, the top surface 251*e* of the lower tray body 251 and the bottom surface 151*a* of the upper tray body 151 are pressed in a contacted state and thus the two surfaces may be completely closely attached to each other.

In this embodiment, when the top surface 251*e* of the lower tray body 251 and the bottom surface 151*a* of the upper tray body 151 disappears, thin strip-shaped ice may be prevented from being formed along a circumference of a sphere-like ice after completing the ice making.

In this embodiment, the rotational center (C2) is disposed outside of the upper chamber 152 and the lower chamber 252.

The first surface 151*a*1 is closer to a rotational center (C2) of the lower assembly 200 than the second surface 151*a*2 among the bottom surface 151*a* of the upper tray body 151. The first surface 151*a*1 is disposed adjacent to a second wall 260*b* of the circumferential wall (260), and the second surface 151*a*2 is disposed adjacent to a first wall 260*a* of the circumferential wall (260).

Thus, a rotational radius of the first surface 151*a*1 is smaller than a rotational radius of the second surface 151*a*2.

In this embodiment, the first surface 151*a*1 is a surface closest to the rotational center (C2) among the bottom surface 151*a* of the upper tray body 151.

The second surface 151*a*2 is a surface closest to the rotational center (C2) among the bottom surface 151*a* of the upper tray body 151.

<A Phenomenon when the Bottom Surface 151*a* of the Upper Tray Body 151 is Formed to Identically have Heights as a Horizontal Surface Overall>

The present invention focuses on the assumption that the bottom surface 151*a* of the upper tray body 151 is formed to identically have heights as a horizontal surface overall.

As described above, the first surface 151*a*1 is closer to the rotational center (C2) of the lower assembly 200 than the second surface 151*a*2 among the bottom surface 151*a* of the upper tray body 151.

Thus, in the process of rotating the lower assembly 200 in the reverse direction, the top surface 251*e* of the lower tray body 251 contacts the first surface 151*a*1 among the bottom surface 151*a* of the upper tray body 151, whereas the top surface 251*e* is spaced apart from the second surface 151*a*2.

In this state, when the lower assembly 200 is additionally rotated in the reverse direction, in a state that the top surface 251*e* of the lower tray body 251 contacts the first surface 151*a*1, the top surface 251*e* and the first surface 151*a*1 are pressed to each other, an overlap amount (an amount pushed by pressurization) between the top surface 251*e* of the lower tray body 251 and the first surface 151*a*1 is increased.

A contact area between the top surface 251*e* of the lower tray body 251 and the bottom surface 151*a* of the upper tray body 151 is increased.

However, even though the top surface 251*e* of the lower tray body 251 has rotated to be horizontalized, the top surface 251*e* of the lower tray body 251 may not contact the second surface 151*a*2 among the bottom 151*a* of the upper tray body 151.

In this state, when supplying water, a gap between the top surface 251*e* of the lower tray body 251 and the second surface 151*a*2 among the bottom surface 151*a* of the lower tray body 251 and an interval between the vertical wall 153*a* of the upper tray body 151 and the first wall 260*a* of the lower tray body 251 are filled.

If so, strip-shaped ice is present along a circumference of the ice after completing the ice making.

<The Effect when the Bottom 151*a* of the Upper Tray Body 151 is Formed with an Inclined Surface>

On the other hand, in this embodiment, the bottom surface 151*a* of the upper tray body 151 is inclined downward as the first surface 151*a*1 close to the rotational center (C2) goes farther to the second surface 151*a*2 farthest from the rotational center (C2).

Therefore, in the process of rotation of the lower assembly 200 in the reverse direction, when the top surface 251*e* of the lower tray body 251 contacts the first surface 151*a*1 among the bottom 151*a* of the upper tray body 151, the second surface 151*a*2 also contacts the top surface 251*e* of the bottom tray body 251.

When the lower assembly 200 is additionally rotated in the reverse direction, in a state that the top surface 251*e* of the lower tray body 251 contacts the first surface 151*a*1, the top surface 251*e* and the first surface 151*a*1 are pressed to each other, an overlap amount (an amount pushed by pressurization) between the top surface 251*e* of the lower tray body 251 and the first surface 151*a*1 is increased.

In addition, in a state that the top surface 251*e* of the lower tray body 251 contacts the second surface 151*a*2, the top surface 251*e* and the first surface 151*a*1 are pressed to each other, an overlap amount (an amount pushed by pressurization) between the top surface 251*e* of the lower tray body 251 and the second surface 151*a*2 is increased.

That is, since the top surface 251*e* of the lower tray body 251 overall contacts and attaches to the bottom 151*a* of the upper tray body 151, the gap between the top surface 251*e* of the lower tray body 251 and the bottom surface 151*a* of the upper tray body 151 is prevented from being generated.

Thus, the strip-shaped ice may be prevented from being formed along the circumference of the ice after completing the ice making.

The first extension part 253 of the lower tray 250 is seated on the top surface 271*a* of the support body 271 of the lower support 270. Also, the second extension wall 286 of the lower support 270 contacts a side surface of the first extension part 253 of the lower tray 250.

The second extension part 254 of the lower tray 250 may be seated on the second extension wall 286 of the lower support 270.

In the state in which the bottom surface 151*a* of the upper tray body 151 is seated on the top surface 251*e* of the lower tray body 251, the upper tray body 151 may be accommodated in an inner space of the circumferential wall 260 of the lower tray 250.

Here, the vertical wall 153*a* of the upper tray body 151 may be disposed to face the vertical wall 260*a* of the lower tray 250, and the curved wall 153*b* of the upper tray body 151 may be disposed to face the second wall 260*b* of the lower tray 250.

An outer face of the chamber wall 153 of the upper tray body 151 is spaced apart from an inner face of the circumferential wall 260 of the lower tray 250. That is, a space may be defined between the outer face of the chamber wall 153 of the upper tray body 151 and the inner face of the circumferential wall 260 of the lower tray 250.

Water supplied through the water supply part 180 is accommodated in the ice chamber 111. When a relatively large amount of water than a volume of the ice chamber 111 is supplied, water that is not accommodated in the ice chamber 111 may flow into the space between the outer face of the chamber wall 153 of the upper tray body 151 and the inner face of the circumferential wall 260 of the lower tray 250.

Thus, according to this embodiment, even though a relatively large amount of water than the volume of the ice chamber 111 is supplied, the water may be prevented from overflowing from the ice maker 100.

As this embodiment, although a space between an outer surface of a chamber wall 153 of the upper tray body 151 and an inner surface of a circumferential wall 260 of the lower tray 250 is filled with water after completing water supply, the gap between the top surface 251*e* of the lower tray body 251 and the bottom surface 151*a* of the upper tray body 151 is not generated.

Thus, since the ice generated in the space between an outer surface of the chamber wall 153 of the upper tray body 151 and an inner surface of the circumferential wall 260 of the lower tray 250 is completely separated from the ice generated in the ice chamber 111, the strip-shaped ice may be prevented from being generated along the circumference of the sphere-like ice.

In a state that the top surface 251*e* of the lower tray body 251 contacts the bottom surface 151*a* of the upper tray body 151, a top surface of the circumferential wall 260 may be higher than the opening 154 or the upper chamber 152 of the upper tray 150.

A heater contact part 251*a* for allowing the contact area with the lower heater 296 to increase may be further provided on the lower tray body 251.

The heater contact portion 251*a* may protrude from the bottom surface of the lower tray body 251. In one example, the heater contact portion 251*a* may be formed in a ring shape and disposed on the bottom surface of the lower tray body 251. The bottom surface of the heater contact portion 251*a* may be planar.

The present invention is not limited, but the lower heater 296 may be lower than a middle point of a height of the lower chamber 252 in a state that the lower heater 296 contacts the heater contact portion 251*a*.

The lower tray body 251 may further include a convex portion 251*b* in which a portion of the lower portion of the lower tray body 251 is convex upward. That is, the convex portion 251*b* may be convex toward the inside of the ice chamber 111.

A recess 251*c* may be defined below the convex portion 251*b* so that the convex portion 251*b* has substantially the same thickness as the other portion of the lower tray body 251.

In this specification, the "substantially the same" is a concept that includes completely the same shape and a shape that is not similar but there is little difference.

The convex portion 251*b* may be disposed to vertically face the lower opening 274 of the lower support 270.

The lower opening 274 may be defined just below the lower chamber 252. That is, the lower opening 274 may be defined just below the convex portion 251*b*.

The convex portion 251*b* may have a diameter D less than that D2 of the lower opening 274.

When cold air is supplied to the ice chamber 111 in the state in which the water is supplied to the ice chamber 111, the liquid water is phase-changed into solid ice. Here, the water may be expanded while the water is changed in phase. The expansive force of the water may be transmitted to each of the upper tray body 151 and the lower tray body 251.

In case of this embodiment, although other portions of the lower tray body 251 are surrounded by the support body 271, a portion (hereinafter, referred to as a "corresponding portion") corresponding to the lower opening 274 of the support body 271 is not surrounded.

If the lower tray body 251 has a complete hemispherical shape, when the expansive force of the water is applied to the corresponding portion of the lower tray body 251 corresponding to the lower opening 274, the corresponding portion of the lower tray body 251 is deformed toward the lower opening 274.

In this case, although the water supplied to the ice chamber 111 exists in the spherical shape before the ice is made, the corresponding portion of the lower tray body 251 is deformed after the ice is made. Thus, additional ice having a projection shape may be made from the spherical ice by a space occurring by the deformation of the corresponding portion.

Thus, in this embodiment, the convex portion 251*b* may be disposed on the lower tray body 251 in consideration of the deformation of the lower tray body 251 so that the ice has the completely spherical shape.

In this embodiment, the water supplied to the ice chamber 111 is not formed into a spherical form before the ice is generated. After the generation of the ice is completed, the convex portion 251*b* of the lower tray body 251 is deformed toward the lower opening 274, such that the spherical ice may be generated.

In the present embodiment, the diameter D1 of the convex portion 251*b* is smaller than the diameter D2 of the lower opening 274, such that the convex portion 251 *b* may be deformed and positioned inside the lower opening 274.

Figure 28:
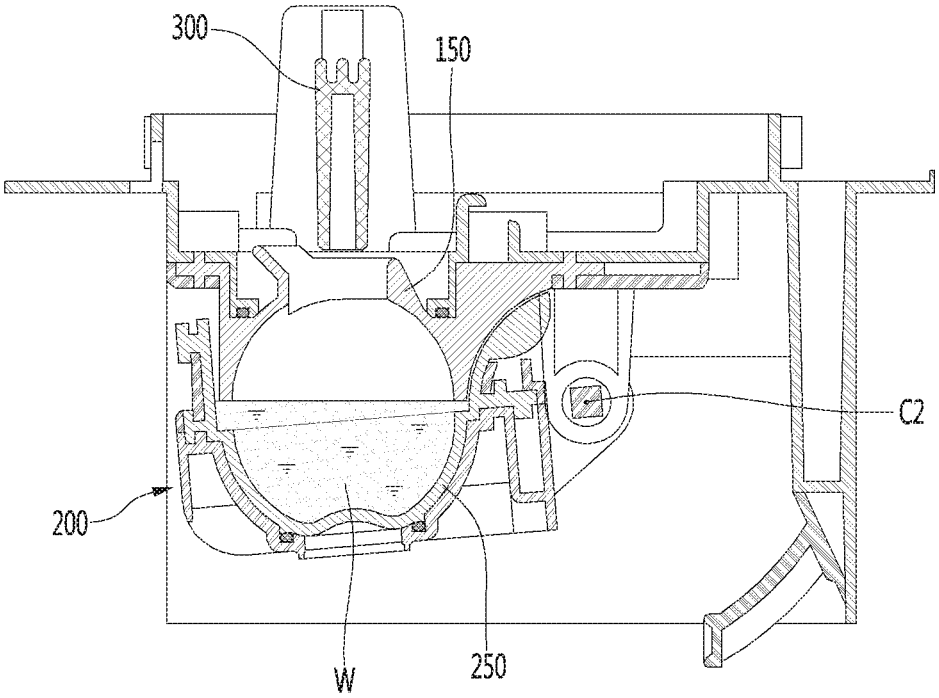
FIG. 28 is a cross-sectional view taken along line B-B of FIG. 3 in a water supply state.
Figure 29:
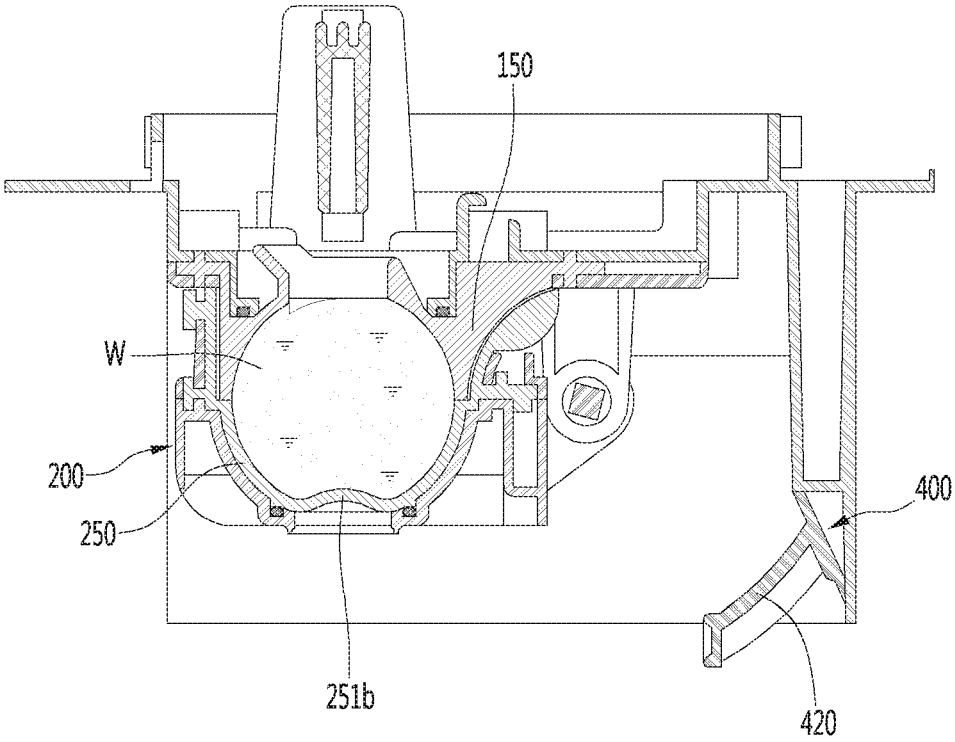
FIG. 29 is a cross-sectional view taken along line B-B of FIG. 3 in an ice making state.

FIG. 28 is a cross-sectional view taken along line B-B of FIG. 3 in a water supply state, and FIG. 29 is a cross-sectional view taken along line B-B of FIG. 3 in an ice making state.

Figure 30:
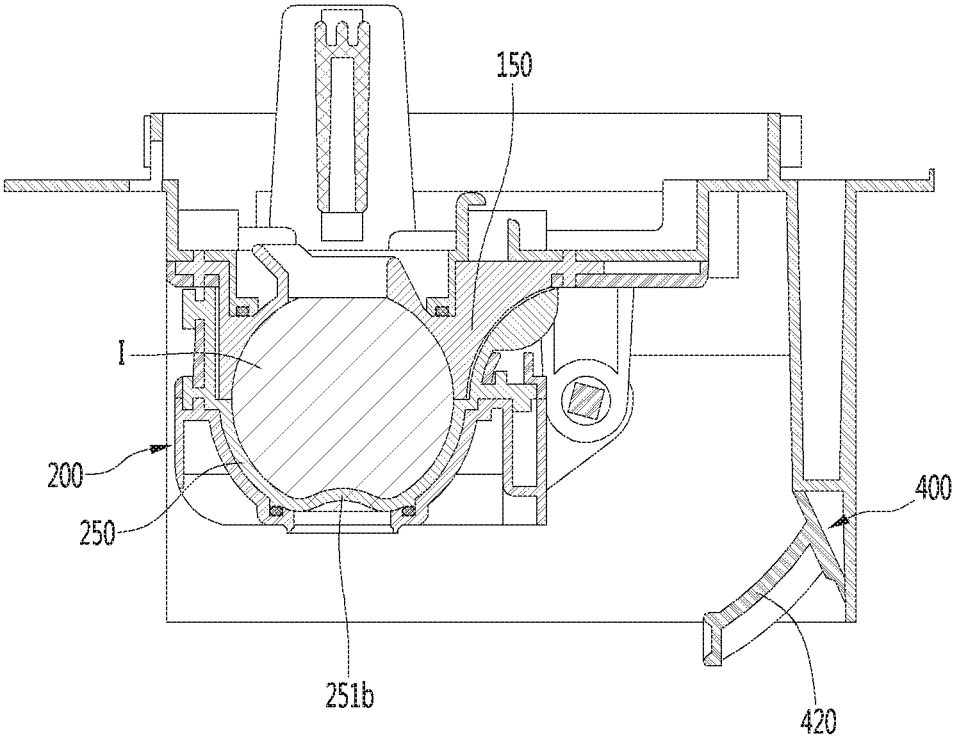
FIG. 30 is a cross-sectional view taken along line B-B of FIG. 3 in an ice-making completed state.
Figure 31:
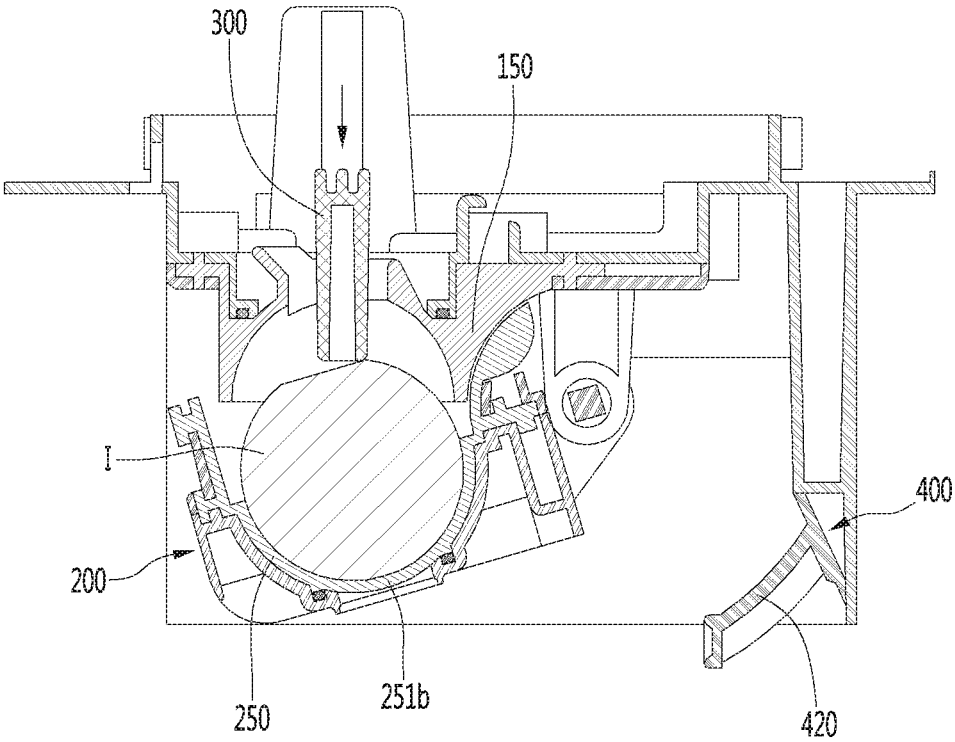
FIG. 31 is a cross-sectional view taken along line B-B of FIG. 3 in an initial state of ice separation.
Figure 32:
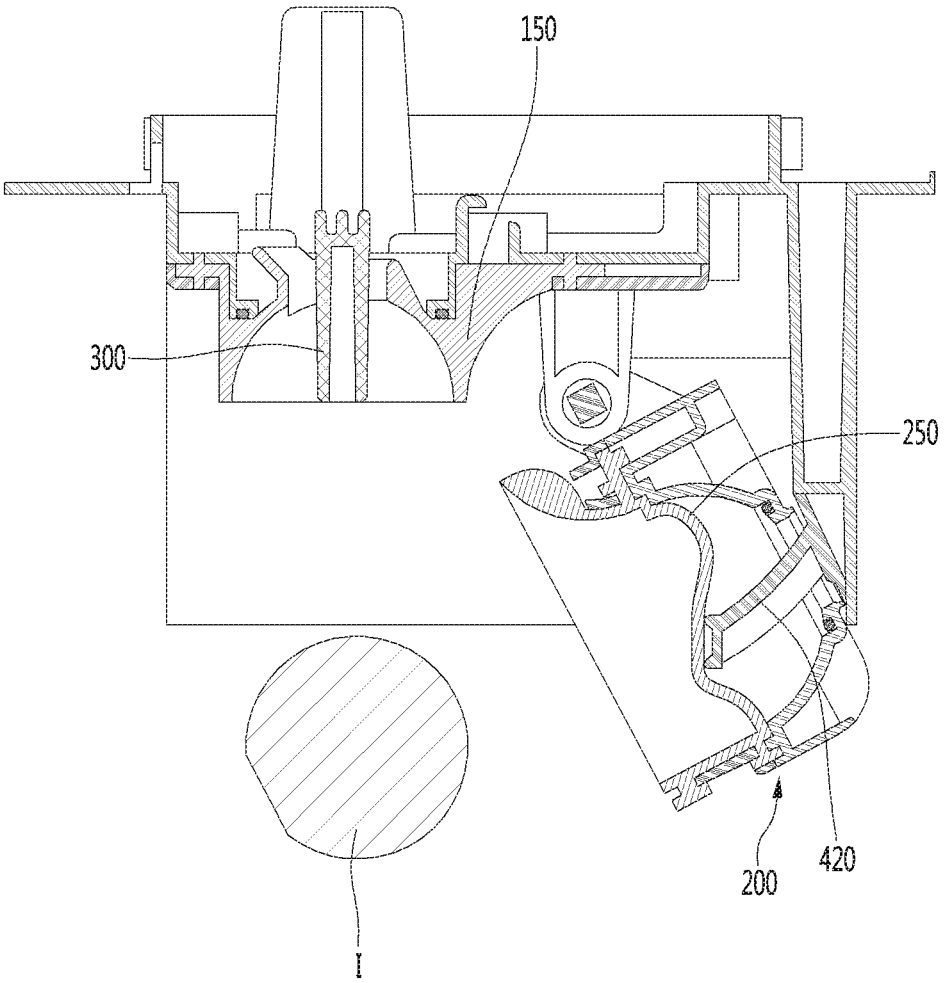
FIG. 32 is a cross-sectional view taken along line B-B of FIG. 3 in an ice separation completed state.

FIG. 30 is a cross-sectional view taken along line B-B of FIG. 3 in a state in the ice-making completed state, FIG. 31 is a cross-sectional view taken along line B-B of FIG. 3 in an initial state of ice separation, and FIG. 32 is a cross-sectional view taken along line B-B of FIG. 3 in an ice separation completed state.

Referring to FIGS. 28 to 32, first, the lower assembly 200 rotates to a water supply position.

The top surface 251*e* of the lower tray 250 is spaced apart from the bottom surface 151*e* of the upper tray 150 at the water supply position of the lower assembly 200.

Although not limited, the bottom surface 151*e* of the upper tray 150 may be disposed at a height that is equal or similar to a rotational center C2 of the lower assembly 200.

Although not limited, an angle between the top surface 251*e* of the lower tray 250 and the bottom surface 151*e* of the upper tray 150 at the water supply position of the lower assembly 200 may be about 8 degrees.

In this state, the water is guided by the water supply part 190 and supplied to the ice chamber 111.

In this connection, the water is supplied to the ice chamber 111 through one upper opening of the plurality of upper openings 154 of the upper tray 150.

In the state in which the supply of the water is completed, a portion of the supplied water may be fully filled into the lower chamber 252, and the other portion of the supplied water may be fully filled into the space between the upper tray 150 and the lower tray 250.

For example, the upper chamber 151 may have the same volume as that of the space between the upper tray 150 and the lower tray 250. Thus, the water between the upper tray 150 and the lower tray 250 may be fully filled in the upper tray 150. In another example, the volume of the upper chamber 152 may be larger than the volume of the space between the upper tray 150 and the lower tray 250.

In case of this embodiment, a channel for communication between the three lower chambers 252 may be provided in the lower tray 250.

As described above, although the channel for the flow of the water is not provided in the lower tray 250, since the top surface 251*e* of the lower tray 250 and the bottom surface 151*e* of the upper tray 150 are spaced apart from each other, the water may flow to the other lower chamber along the top surface 251*e* of the lower tray 250 when the water is fully filled in a specific lower chamber in the water supply process.

Thus, the water may be fully filled in each of the plurality of lower chambers 252 of the lower tray 250.

In the case of this embodiment, since the channel for the communication between the lower chambers 252 is not provided in the lower tray 250, additional ice having a projection shape around the ice after the ice making process may be prevented being made.

In the state in which the supply of the water is completed, as illustrated in FIG. 29, the lower assembly 200 rotates reversely. When the lower assembly 200 rotates reversely, the top surface 251*e* of the lower tray 250 is close to the bottom surface 151*e* of the upper tray 150.

Thus, the water between the top surface 251*e* of the lower tray 250 and the bottom surface 151*e* of the upper tray 150 may be divided and distributed into the plurality of upper chambers 152.

Also, when the top surface 251*e* of the lower tray 250 and the bottom surface 151*e* of the upper tray 150 are closely attached to each other, the water may be fully filled in the upper chamber 152.

In the state in which the top surface 251*e* of the lower tray 250 and the bottom surface 151*e* of the upper tray 150 are closely attached to each other, a position of the lower assembly 200 may be called an ice making position.

In the state in which the lower assembly 200 moves to the ice making position, ice making is started.

Since pressing force of water during ice making is less than the force for deforming the convex portion 251*b* of the lower tray 250, the convex portion 251*b* may not be deformed to maintain its original shape.

When the ice making is started, the lower heater 296 is turned on. When the lower heater 296 is turned on, heat of the lower heater 296 is transferred to the lower tray 250.

Thus, when the ice making is performed in the state where the lower heater 296 is turned on, ice may be made from the upper side in the ice chamber 111.

That is, water in a portion adjacent to the upper opening 154 in the ice chamber 111 is first frozen. Since ice is made from the upper side in the ice chamber 111, the bubbles in the ice chamber 111 may move downward.

Since the ice chamber 111 is formed in a sphere shape, the horizontal cross-sectional area may vary based on a height of the ice chamber 111.

Thus, the output of the lower heater 296 may vary depending on the height at which ice is produced in the ice chamber 111.

The horizontal cross-sectional area increases as it goes downwardly. Then, the horizontal cross-sectional area becomes maximum at the boundary between the upper tray 150 and the lower tray 250 and decreases as it goes downwardly again.

In the process where ice is generated from a top to a bottom in the ice chamber 111, the ice comes into contact with the top surface of the convex portion 251*b* of the lower tray 250.

In this state, when the ice is continuously made, the block part 251*b* may be pressed and deformed as shown in FIG. 30, and the spherical ice may be made when the ice making is completed.

A control unit (not shown) may determine whether the ice making is completed based on the temperature sensed by the temperature sensor 500.

The lower heater 296 may be turned off at the ice-making completion or before the ice-making completion.

When the ice-making is completed, the upper heater 148 is first turned on for the ice-removal of the ice. When the upper heater 148 is turned on, the heat of the upper heater 148 is transferred to the upper tray 150, and thus, the ice may be separated from the surface (the inner face) of the upper tray 150.

After the upper heater 148 has been activated for a set time duration, the upper heater 148 may be turned off and then the drive unit 180 may be operated to rotate the lower assembly 200 in a forward direction.

As illustrated in FIG. 31, when the lower assembly 200 rotates forward, the lower tray 250 may be spaced apart from the upper tray 150.

Also, the rotation force of the lower assembly 200 may be transmitted to the upper ejector 300 by the connection unit 350. Thus, the upper ejector 300 descends by the unit guides 181 and 182, and the upper ejecting pin 320 may be inserted into the upper chamber 152 through the upper opening 154.

In the ice separating process, the ice may be separated from the upper tray 250 before the upper ejecting pin 320 presses the ice. That is, the ice may be separated from the surface of the upper tray 150 by the heat of the upper heater 148.

In this case, the ice may rotate together with the lower assembly 200 in the state of being supported by the lower tray 250.

Alternatively, even though the heat of the upper heater 148 is applied to the upper tray 150, the ice may not be separated from the surface of the upper tray 150.

Thus, when the lower assembly 200 rotates forward, the ice may be separated from the lower tray 250 in the state in which the ice is closely attached to the upper tray 150.

In this state, while the lower assembly 200 rotates, the upper ejecting pin 320 passing through the upper opening 154 may press the ice closely attached to the upper tray 150 to separate the ice from the upper tray 150. The ice separated from the upper tray 150 may be supported again by the lower tray 250.

When the ice rotates together with the lower assembly 200 in the state in which the ice is supported by the lower tray 250, even though external force is not applied to the lower tray 250, the ice may be separated from the lower tray 250 by the self-weight thereof.

While the lower assembly 200 rotates, even though the ice is not separated from the lower tray 250 by the self-weight thereof, when the lower tray 250 is pressed by the lower ejector 400 as shown in FIG. 37, the ice may be separated from the lower tray 250.

Particularly, while the lower assembly 200 rotates, the lower tray 250 may contact the lower ejecting pin 420.

When the lower assembly 200 continuously rotates forward, the lower ejecting pin 420 may press the lower tray 250 to deform the lower tray 250, and the pressing force of the lower ejecting pin 420 may be transmitted to the ice to separate the ice from the lower tray 250. The ice separated from the surface of the lower tray 250 may drop downward and be stored in the ice bin 102.

After the ice is separated from the lower tray 250, the lower assembly 200 may be rotated in the reverse direction by the drive unit 180.

When the lower ejecting pin 420 is spaced apart from the lower tray 250 in a process in which the lower assembly 200 is rotated in the reverse direction, the deformed lower tray 250 may be restored to its original form. That is, the deformed convex portion 251*b* may be restored to its original form.

In the reverse rotation process of the lower assembly 200, the rotational force is transmitted to the upper ejector 300 by the connecting unit 350, such that the upper ejector 300 is raised, and thus, the upper ejecting pin 320 is removed from the upper chamber 152.

When the lower assembly 200 reaches the water supply position, the drive unit 180 is stopped, and then water supply starts again.

By the proposed invention, as the bottom surface of the upper tray body tray body is formed to have different heights, the top surface of the lower tray body may contact the bottom surface of the upper tray body before the top surface is horizontalized.

Thus, since the bottom surface of the upper tray body and the top surface of the lower tray body contact each other overall, the gap between the bottom surface of the upper tray body and the top surface of the lower tray body may be prevented from being generated.

Thus, the strip-shaped ice may be prevented from being generated along the circumference of a sphere-like ice.

In addition, as each of the upper tray and lower tray is formed of the silicone material, their original shapes can be maintained in spite of repetitive ice making. That is, the plastic deformations of each of the upper tray and the lower tray can be prevented in the process of generating the ice.

What is claimed is:

1. An ice maker comprising:

an upper tray including an upper tray body, the upper tray body defining an upper chamber of an ice chamber, the ice chamber being configured to receive water and form ice therein; and a lower tray that is configured to rotate relative to the upper tray about a rotational center and includes a lower tray body, the lower tray body defining a lower chamber of the ice chamber, wherein:

a top surface of the lower tray body is configured to contact a bottom surface of the upper tray body, the upper chamber of the upper tray body and the lower chamber of the lower tray body are configured to define the ice chamber based on the contact between the top surface of the lower tray body and the bottom surface of the upper tray body, the rotational center is disposed outside of the upper chamber and the lower chamber, the bottom surface of the upper tray body includes a first surface and a second surface disposed farther from the rotational center than the first surface, and wherein a first height from the first surface to a top surface of the upper tray in a first direction orthogonal to the top surface of the upper tray is less than a second height from the second surface to the top surface of the upper tray in the first direction.

2. The ice maker of claim 1, wherein before the top surface of the lower tray body contacts the bottom surface of the upper tray body, the second surface of the upper tray body is positioned lower than the first surface of the upper tray body.

3. The ice maker of claim 1, wherein the bottom surface of the upper tray body is inclined downward from the first surface toward the second surface.

4. The ice maker of claim 1, wherein the first surface of the upper tray body is oriented horizontally or is inclined, and wherein the second surface of the upper tray body is oriented horizontally or is inclined.

5. The ice maker of claim 1, wherein based on the lower tray body being rotated toward the upper tray body, the top surface of the lower tray body contacts the first and second surfaces of the upper tray body before the top surface of the lower tray body becomes horizontally oriented.

6. The ice maker of claim 5, wherein the lower tray body is configured, based on the top surface of the lower tray body making contact with the first and second surfaces of the upper tray body before the lower tray body becomes horizontally oriented, to be additionally rotated toward the upper tray body.

7. The ice maker of claim 6, wherein the lower tray body is configured, based on the top surface of the lower tray body making contact with the first and second surfaces of the upper tray body before the lower tray body becomes horizontally oriented, to be additionally rotated toward to become horizontally oriented.

8. The ice maker of claim 6, wherein the lower tray body is configured, based on the top surface of the lower tray body making contact with the first and second surfaces of the upper tray body before the lower tray body becomes horizontally oriented, to be additionally rotated toward the upper tray body by pressurizing the top surface of the lower tray body against the bottom surface of the upper tray body.

9. The ice maker of claim 1, wherein each of the upper tray and the lower tray is formed of a flexible material or a silicone material.

10. The ice maker of claim 1, wherein the upper tray further comprises a horizontal extension part horizontally extending from a circumference of the upper tray body, and wherein the top surface of the upper tray is a top surface of the horizontal extension part.

11. The ice maker of claim 1, wherein each of the upper chamber and the lower chamber has a hemispherical shape.

12. The ice maker of claim 1, further comprising:

an upper case supporting the upper tray; and a lower supporter supporting the lower tray body and rotatably connected to the upper case, wherein the rotational center is positioned at a center of a hinge body that supports rotation of the lower supporter.

13. The ice maker of claim 12, further comprising a lower heater disposed in the lower supporter and that contacts the lower tray.

14. The ice maker of claim 12, wherein the upper tray further comprises an extension part extending from a circumference of the upper tray body in a direction away from the upper tray body, wherein the upper case is configured to support the extension part at an upper side of the extension part, and wherein the ice maker further comprises an upper support configured to support the extension part at a lower side of the extension part.

15. The ice maker of claim 1, wherein the lower tray further comprises a circumferential wall extending from the lower tray body and surrounding the upper tray body.

16. The ice maker of claim 15, wherein the circumferential wall comprises a second wall disposed adjacent to the first surface and having a curved shape, and a first wall disposed adjacent to the second surface and extending in a vertical direction, and wherein the second wall extends in a direction away from the first wall.

17. The ice maker of claim 16, wherein the upper tray body includes a vertical wall facing the first wall and a curved wall facing the second wall.

18. A refrigerator comprising:

a storage space; and an ice maker configured to generate ice, wherein the ice maker comprises:

an upper tray including an upper tray body, the upper tray body defining an upper chamber of an ice chamber, the ice chamber being configured to receive water and form ice therein, and a lower tray that is configured to rotate relative to the upper tray about a rotational center and includes a lower tray body, the lower tray body defining a lower chamber of the ice chamber, wherein a top surface of the lower tray body is configured to contact a bottom surface of the upper tray body, wherein the upper chamber of the upper tray body and the lower chamber of the lower tray body are configured to define the ice chamber based on the contact between the top surface of the lower tray body and the bottom surface of the upper tray body, wherein the bottom surface of the upper tray body includes a first surface and a second surface disposed farther from the rotational center than the first surface, and wherein a first height from the first surface to a top surface of the upper tray in a first direction orthogonal to the top surface of the upper tray is less than a second height from the second surface to the top surface of the upper tray in the first direction.

19. The refrigerator of claim 18, wherein the second surface of the upper tray body is configured to be positioned lower than the first surface of the upper tray body before the top surface of the lower tray body contacts the bottom surface of the upper tray body.

20. The refrigerator of claim 18, wherein the bottom surface of the upper tray body is inclined downward from the first surface toward the second surface.

21. The refrigerator of claim 18, wherein each of the upper tray and the lower tray is formed of a flexible material or a silicone material.

22. The refrigerator of claim 18, wherein the upper tray further comprises a horizontal extension part horizontally extending from a circumference of the upper tray body, and wherein the top surface of the upper tray is a top surface of the horizontal extension part.

* * * * *